US008192001B2

(12) United States Patent
Umeda

(10) Patent No.: US 8,192,001 B2
(45) Date of Patent: Jun. 5, 2012

(54) CARTRIDGE EJECTION APPARATUS FOR INKJET PRINTING

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 823 days.

(21) Appl. No.: 12/186,418

(22) Filed: Aug. 5, 2008

(65) Prior Publication Data

US 2009/0039002 A1 Feb. 12, 2009

(30) Foreign Application Priority Data

Aug. 6, 2007 (JP) ..... 2007-204044

(51) Int. Cl.
*B41J 2/175* (2006.01)
*B41J 3/00* (2006.01)

(52) U.S. Cl. ..... 347/86; 347/2

(58) Field of Classification Search ..... None
See application file for complete search history.

(56) References Cited

U.S. PATENT DOCUMENTS 7,322,683 B2 * 1/2008 Youngberg ..... 347/85

FOREIGN PATENT DOCUMENTS

JP 2007-069541 A 3/2007
JP 2007069541 A * 3/2007

* cited by examiner

*Primary Examiner* — Matthew Luu
*Assistant Examiner* — Erica Lin
(74) *Attorney, Agent, or Firm* — Baker Botts L.L.P.

(57) ABSTRACT

A liquid droplet ejecting apparatus comprises a liquid cartridge including a first unit having a liquid storing chamber and a liquid outlet, a second unit movable relative to the first unit between a close position where the second unit is close to the first unit and a distant position where the second unit is distant from the first unit; and a biasing member which applies a force to cause the second unit in the close position to move toward the distant position. The locking device is configured to lock the second unit in the close position in a state where the liquid cartridge is mounted to the cartridge mounting portion. When the second unit moves from the close position to the distant position under the force applied from the biasing member, in an unlocking state, the liquid inlet and the liquid outlet are maintained to be coupled to each other.

11 Claims, 19 Drawing Sheets

CARTRIDGE EJECTION APPARATUS FOR INKJET PRINTING

CROSS REFERENCE TO RELATED APPLICATION

This application claims priority to and the benefit of Japanese Patent Application No. 2007-204044, filed Aug. 6, 2007, the entire disclosure of which is incorporated herein by reference.

BACKGROUND OF THE INVENTION

1. Field of the Invention

The present invention relates to a liquid droplet ejecting apparatus such as an ink jet printer.

2. Description of Related Art

In a known color ink jet printer, when it is detected that any of a plurality of ink cartridges arranged to store a plurality of colors of inks is empty, this information is displayed as a warning on a user operation screen. Glancing this information, the user opens a cover of a main body of the ink jet printer, detaches the empty ink cartridge and changes it with a new one.

However, if the user opens the cover without correctly recognizing the color (black, cyan, magenta, or yellow) of the empty ink cartridge after the user glances the warning displayed on the operation screen, the user may sometimes inadvertently detach a different ink cartridge.

Accordingly, there has been disclosed an ink jet printer, in which an empty ink cartridge, which is selected from a plurality of ink cartridges, is entirely detached from a carriage and is automatically ejected outside the printer and a new ink cartridge supplied by the user is automatically mounted to the carriage by an automatic loading system (see Japanese Laid-Open Patent Application Publication No. 2007-69541). Since this ink jet printer carries out an operation for changing the empty ink cartridge semi-automatically, it is possible to avoid that the user inadvertently detaches a different ink cartridge which is not empty. Thus, this ink jet printer is convenient to the user However, in the ink jet printer disclosed in Japanese Laid-Open Patent Application Publication No. 2007-69541, since the empty ink cartridge is entirely automatically ejected, an ink supply passage between the empty ink cartridge and a main body of the printer is automatically opened. In this case, unless the user promptly supplies a new ink cartridge, air bubbles or foreign matter such as dust, are likely to enter the ink supply passage through a joint between the empty ink cartridge and the main body of the printer, or droplets of remaining ink are likely to fall from the joint.

SUMMARY OF THE INVENTION

The present invention has been developed to solve the above described problem, and an object of the present invention is to enable a user to easily and surely change a cartridge while preventing entry of air bubbles or foreign matter, such as dust, into a liquid supply passage or falling of ink droplets.

According to an aspect of the present invention, a liquid droplet ejecting apparatus comprises a liquid cartridge including a liquid storing chamber and a liquid outlet, the liquid storing chamber being configured to store a liquid, the liquid outlet being configured to outflow the liquid stored in the liquid storing chamber; a cartridge mounting portion configured to mount the liquid cartridge thereto removably, the cartridge mounting portion having a liquid inlet coupled to the liquid outlet of the liquid cartridge mounted to the cartridge mounting portion; a liquid ejecting head configured to be supplied with the liquid inflowing from the liquid inlet and eject the supplied liquid; and a locking device configured to lock the liquid cartridge mounted to the cartridge mounting portion; wherein the liquid cartridge includes a first unit having the liquid storing chamber and the liquid outlet; a second unit configured to move relative to the first unit between a close position where the second unit is close to the first unit and a distant position where the second unit is distant from the first unit; and a biasing member configured to apply a force to cause the second unit in the close position to move toward the distant position; wherein the locking device is configured to lock the second unit in the close position in a state where the liquid cartridge is mounted to the cartridge mounting portion; and wherein in response to that the second unit moves from the close position to the distant position under the force applied from the biasing member, in a state where the locking device is in an unlocking state, the liquid inlet and the liquid outlet are maintained to be coupled to each other.

In accordance with such a configuration, the second unit can be moved relative to the first unit under the force applied from the biasing member in the state where the liquid outlet of the liquid cartridge is coupled to the liquid inlet of the cartridge mounting portion, thereby changing the outer shape of the liquid cartridge. For example, the state where the second unit is locked in position against the force applied from the biasing member can be changed to the state where only the second unit of the empty liquid cartridge is unlocked and thereby its outer shape is changed. This enables the user to easily visually check the liquid cartridge to be detached without opening the liquid supply passage between the liquid cartridge and the cartridge mounting portion. As a result, the user is able to easily and surely change the ink cartridge while preventing entry of air bubbles and foreign matter, such as dust, into the liquid supply passage or falling of ink droplets.

A force for coupling the liquid outlet and the liquid inlet to each other may be set so that the liquid outlet and the liquid inlet are maintained to be coupled to each other in response to that the second unit moves from the close position to the distant position under the force applied from the biasing member.

In accordance with such a configuration, even when an inertia force is generated in the liquid cartridge by the movement of the second unit relative to the first unit under the force applied from the biasing member, in the unlocking state, the coupling state between the liquid outlet and the liquid inlet can be surely maintained. This makes it possible to suitably prevent entry of the air bubbles and others through the liquid inlet, even if it takes a relatively long time for the user to actually grab and detach the liquid cartridge.

A force for coupling the liquid outlet and the liquid inlet to each other may be set larger than a force applied to the first unit in response to that the second unit moves from the close position to the distant position under the force applied from the biasing member.

In accordance with such a configuration, even when the inertia force is generated in the liquid cartridge by the movement of the second unit relative to the first unit under the force applied from the biasing member, in the unlocking state, the coupling state between the liquid outlet and the liquid inlet can be surely maintained. This makes it possible to suitably prevent entry of the air bubbles and others through the liquid inlet, even if it takes a relatively long time for the user to actually grab and detach the liquid cartridge.

In a state where the liquid inlet and the liquid outlet are coupled to each other, the second unit in the distant position may be grabbed by a user more easily than the second unit in the close position.

In accordance with such a configuration, since the user can easily grab the second unit in the distant position and detach the liquid cartridge, efficiency of the operation for changing the liquid cartridge is increased.

In a state where the liquid inlet and the liquid outlet are coupled to each other, the second unit in the distant position may be more distant from the liquid inlet than the second unit in the close position.

In accordance with such an operation, since the user can easily grab the liquid cartridge, efficiency of the operation for changing the liquid cartridge is increased.

The cartridge mounting portion may be configured to mount a plurality of liquid cartridges. In a state where the liquid inlet and the liquid outlet are coupled to each other, the second unit in the distant position may be more distant from adjacent liquid cartridges than the second unit in the close position.

In accordance with such an operation, since the user can easily grab the liquid cartridge, efficiency of the operation for changing the liquid cartridge is increased.

The liquid droplet ejecting apparatus may further comprise a cover configured to open and close an entrance for the cartridge mounting portion. In a state where the liquid inlet and the liquid outlet are coupled to each other, the second unit in the distant position may be closer to the cover than the second unit in the close position.

In accordance with such an operation, since the user can easily grab the liquid cartridge, efficiency of the operation for changing the liquid cartridge is increased.

The liquid droplet ejecting apparatus may further comprise an actuator configured to perform an unlocking operation of the locking device; and a controller configured to control the actuator to perform the unlocking operation.

In accordance with such a configuration, the liquid cartridge can be easily changed under automatic control.

The liquid droplet ejecting apparatus may further comprise a liquid amount detector configured to detect a liquid empty state in which an amount of the liquid stored in the liquid cartridge is a predetermined amount or less. The controller may control the actuator to perform the unlocking operation of the locking device, based on the liquid empty state detected by the liquid amount detector In accordance with such a configuration, since the second unit of the empty liquid cartridge moves relative to the first unit, the user can easily recognize the empty liquid cartridge. Therefore, it becomes possible to avoid that the user inadvertently pulls out the liquid cartridge which is not empty and to effectively prevent entry of air bubbles or foreign matter, such as dust, or falling of liquid droplets.

The liquid droplet ejecting apparatus may further comprise a cover configured to open and close an entrance for the cartridge mounting portion; a cover opening operation detector configured to detect that the cover is open; and a liquid amount detector configured to detect a liquid empty state in which an amount of the liquid stored in the liquid cartridge is a predetermined amount or less. The controller may control the actuator to perform the unlocking operation of the locking device, in response to that the liquid amount detector detects the liquid empty state and the cover opening operation detector detects that the cover is open.

In accordance with such a configuration, when the liquid cartridge becomes empty and the user opens the cover, the second unit of the empty liquid cartridge moves relative to the first unit. Therefore, it becomes possible to avoid that the user inadvertently pulls out the liquid cartridge which is not empty and to effectively prevent entry of air bubbles or foreign matter, such as dust, or falling of liquid droplets.

The liquid droplet ejecting apparatus may further comprise an ejection command generator configured to generate an ejection command in response to a user's operation. The controller may control the actuator to perform the unlocking operation of the locking device based on the ejection command.

In accordance with such a configuration, the detaching operation of the liquid cartridge can be easily carried out according to the user's will. Thus, the user can use the apparatus more conveniently.

The cartridge mounting portion may be configured to mount a plurality of liquid cartridges. The locking device may be a part of a plurality of locking devices respectively corresponding to the plurality of liquid cartridges. The controller may control the actuator to perform the unlocking operation of a specified locking device which is selected from the plurality of locking devices.

In accordance with such a configuration, since the liquid cartridge to be detached operates in a manner different from that of other liquid cartridges, the user can easily recognize the liquid cartridge to be detached.

The actuator may include a solenoid.

In accordance with such a configuration, the user can change the liquid cartridge simply and surely while preventing entry of air bubbles and foreign matter, such as dust, into the liquid supply passage, with a simple configuration.

The actuator may include a dielectric elastomer and a pair of electrodes respectively formed on both surfaces of the dielectric elastomer.

In accordance with such a configuration, the user can change the liquid cartridge simply and surely while preventing entry of air bubbles and foreign matter, such as dust, into the liquid supply passage, with a compact configuration.

The locking device may include a hand-operated switch with which an unlocking operation is performed.

In accordance with such a configuration, the user can change the liquid cartridge simply and surely while preventing entry of air bubbles and foreign matter, such as dust, into the liquid supply passage, with a compact configuration in which the unlocking operation is not controlled.

According to another aspect of the present invention, a liquid droplet ejecting apparatus may comprise a cartridge mounting portion configured to mount a liquid cartridge, the liquid cartridge including a first unit having a liquid storing chamber and a liquid outlet, a second unit configured to move relative to the first unit between a close position where the second unit is close to the first unit and a distant position where the second unit is distant from the first unit, and a biasing member configured to apply a force to cause the second unit in the close position to move toward the distant position, the cartridge mounting portion having a liquid inlet coupled to the liquid outlet of the liquid cartridge mounted to the cartridge mounting portion; a liquid ejecting head configured to be supplied with the liquid inflowing from the liquid inlet and eject the supplied liquid; and a locking device configured to lock the liquid cartridge mounted to the cartridge mounting portion; wherein the locking device is configured to lock the second unit in the close position in a state where the liquid cartridge is mounted to the cartridge mounting portion; and wherein in response to that the second unit moves from the close position to the distant position under the force applied from the biasing member, in a state where the locking device is in an unlocking state, the liquid inlet and the liquid outlet are maintained to be coupled to each other.

In accordance with such a configuration, the second unit can be moved relative to the first unit under the force applied from the biasing member in the state where the liquid outlet of the liquid cartridge is coupled to the liquid inlet of the cartridge mounting portion, thereby changing the outer shape of the liquid cartridge. For example, the state where the second unit is locked in position against the force applied from the biasing member can be changed to the state where only the second unit of the empty cartridge is unlocked and thereby its outer shape is changed. This enables the user to easily visually check the liquid cartridge to be detached without opening the liquid supply passage between the liquid cartridge and the cartridge mounting portion. As a result, the user is able to easily and surely change the ink cartridge while preventing entry of air bubbles and foreign matter, such as dust, into the liquid supply passage or falling of ink droplets.

BRIEF DESCRIPTION OF THE DRAWING

Embodiments of the invention now are described with reference to the accompanying drawings, which are given by way of example only, and are not intended to limit the present invention.

DETAILED DESCRIPTION OF THE PREFERRED EMBODIMENTS

Preferred embodiments of the present invention, and their features and advantages, may be understood by referring to accompanying drawings, like numerals being used for corresponding parts in the various drawings. For ease of discussion, in the following description, directions are defined as viewed from a user when operating a multifunction machine 1 as indicated by the arrows in FIG. 1. With regard to various individual objects of the multifunction machine 1, sides of the individual objects will be similarly identified based on the arranged/attached position of the object on/in the multifunction machine 1 shown in FIG. 1.

(Embodiment 1)

Figure 1:
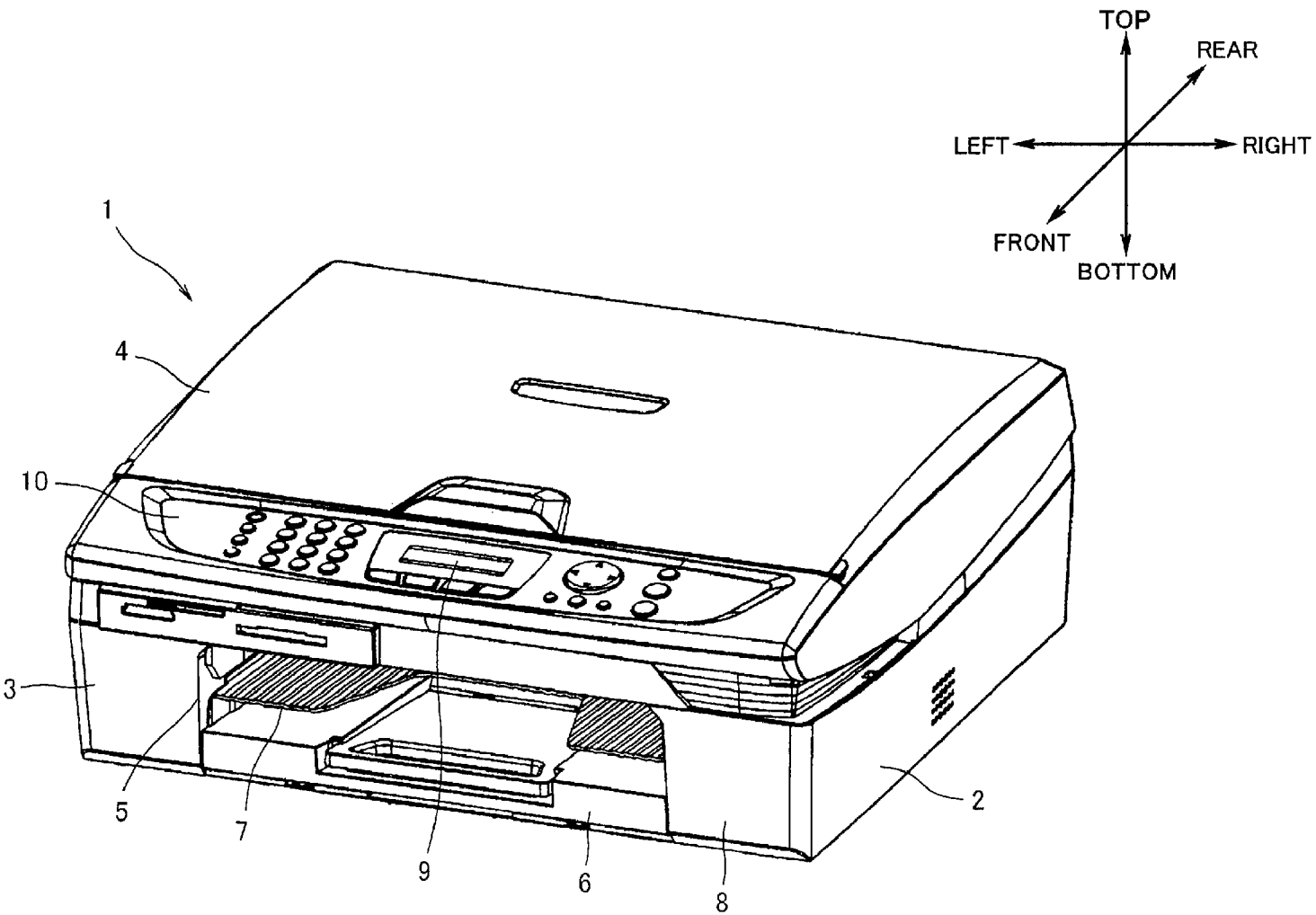
FIG. 1 is a perspective view of a multifunction machine including an ink jet printer according to a first embodiment of the present invention.

As shown in FIG. 1, a multifunction machine 1, which is capable of printing, scanning, copying, and facsimile transmission, has an ink jet printer 3 at a lower part of a casing 2, and a scanner 4 at an upper part of the casing 2. An opening 5 is provided on a front face of the casing 2. A sheet supply tray 6 of the ink jet printer 3 is provided at a lower portion of the opening 5 and a sheet discharge tray 7 of the ink jet printer 3 is provided at an upper portion of the opening 5. A cover 8 is provided at a right lower part of on the front face side of the ink jet printer 3. A cartridge mounting portion 19 (see FIGS. 2 and 3) is provided inside the cover 8. An operation panel 10 is provided at a front face side of an upper part of the multifunction machine 1. The operation panel 10 includes a display 9 and function keys to operate the ink jet printer 3, the scanner 4 and the like. The multifunction machine 1 is operable based on an instruction sent from an external personal computer (not shown).

Figure 2:
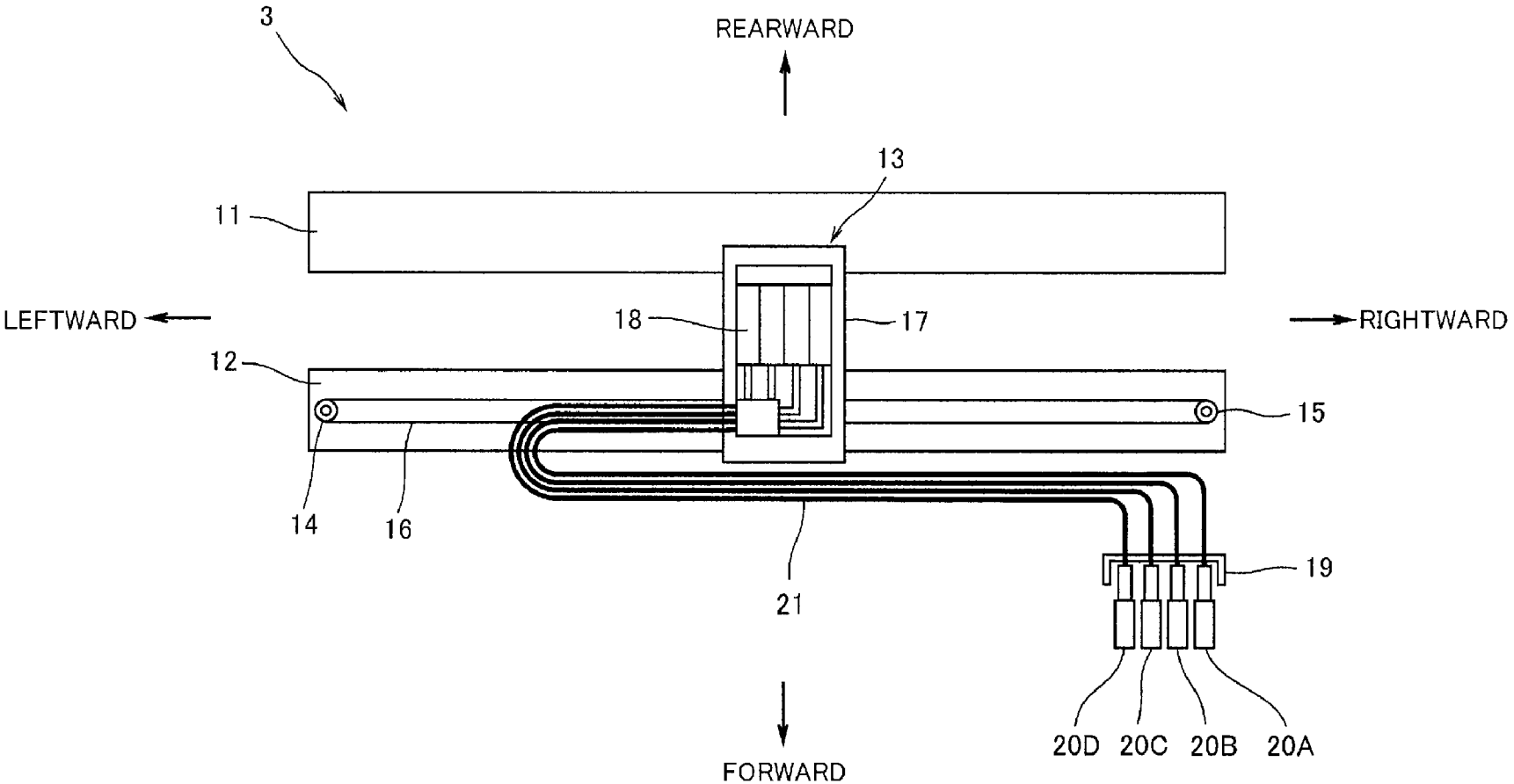
FIG. 2 is a plan view schematically showing the ink jet printer of FIG. 1.

As shown in FIG. 2, the ink jet printer 3 is provided with a pair of guide rails 11 and 12 arranged generally in parallel. An image recording unit 13 is supported on the guide rails 11 and 12 to be slidable in a scanning direction. The imaging unit 13 is joined to a timing belt 16 installed around a pair of pulleys 14 and 15. The timing belt 16 is provided to extend in a direction generally parallel to a direction in which the guide rail 12 extends. A motor (not shown), which rotates clockwise or counterclockwise, is attached to the pulley 15. The motor causes the pulley 15 to rotate clockwise or counterclockwise, causing the timing belt 16 to reciprocate, so that the image recording unit 13 is scanned along the guide rails 11 and 12.

The image recording unit 13 has a carriage 17 which is a casing. The carriage 17 is provided with four buffer tanks 18. A cartridge mounting portion 19 is provided on a right side in front of the guide rail 12. Four ink cartridges 20A to 20D which respectively contain four colors (black, cyan, magenta, and yellow) of inks are removably mounted to the cartridge mounting portion 19. The ink cartridges 20A to 20D mounted to the cartridge mounting portion 19 are respectively coupled to the buffer tanks 18 through ink supply tubes 21.

Figure 3:
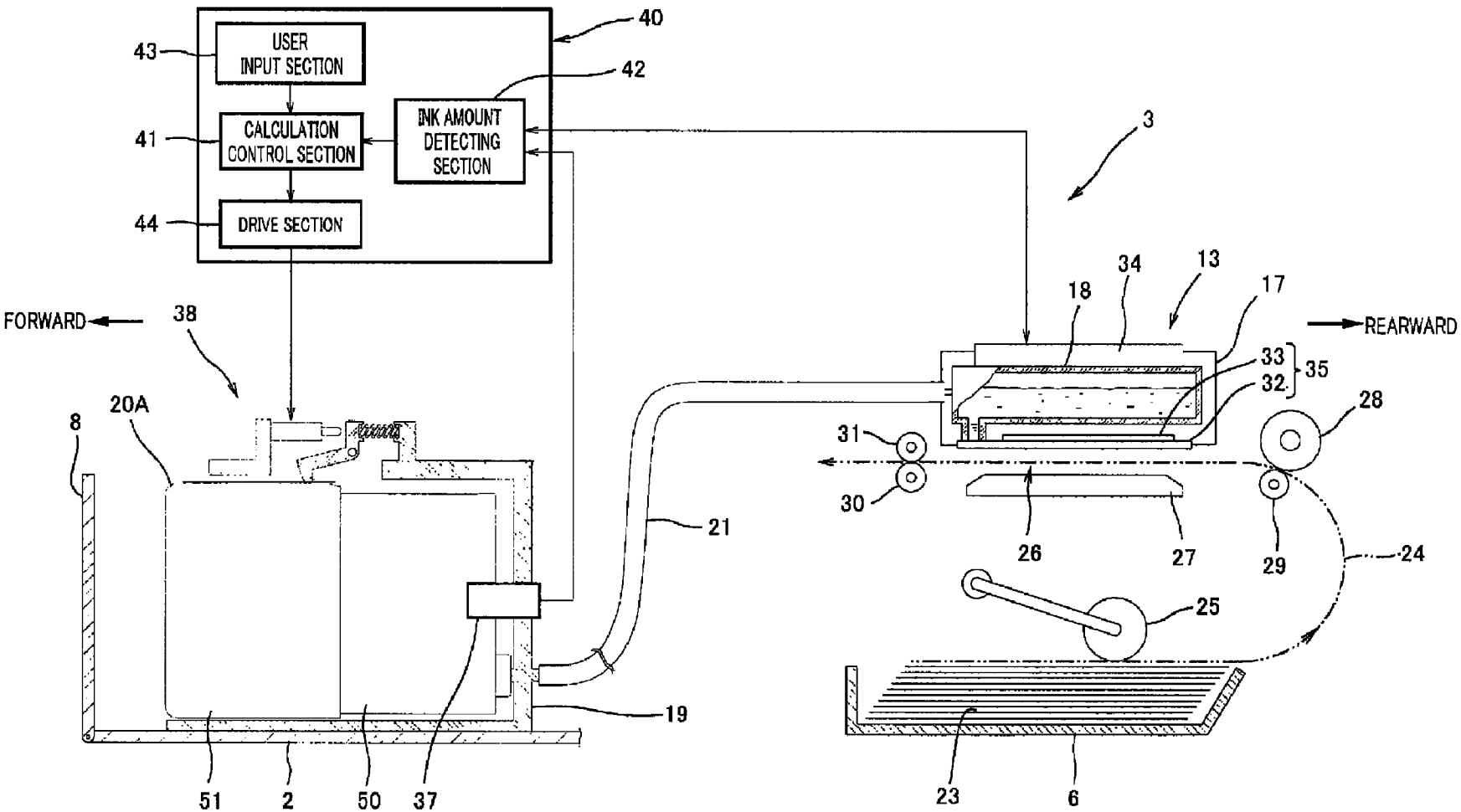
FIG. 3 is a partial cross-sectional view schematically showing the ink jet printer of FIG. 1.

As shown in FIG. 3, the sheet supply tray 6 is disposed at a bottom side of the multifunction machine 1. A sheet supply drive roller 25 is provided on an upper side of the sheet supply tray 6 to supply to a feed path 24 an uppermost sheet of a stack of recording sheets 23 in the sheet supply tray 6. The feed path 24 extends upward from a back surface side of the sheet supply tray 6, then turns back toward the front face, and is guided to the sheet discharge tray 7 (see FIG. 1) through a printing area 26.

The image recording unit 13 is disposed in the printing area 26. A platen 27, which is larger than sheet in size, is disposed under the image recording unit 13. A feed roller 28 and a pinch roller 29 are provided upstream of the image recording unit 13 to squeeze the recording sheet 23 being fed through the feed path 24 to the platen 27. A sheet discharge roller 30 and a pinch roller 31 are provided downstream of the image recording unit 13 to squeeze the recording sheet 23 on which the image has been recorded and to feed it to the sheet discharge tray 7 (see FIG. 1).

The image recording unit 13 includes a known ink jet head 35 which ejects ink from a number of nozzles toward the platen 27, the buffer tanks 18 which temporarily store inks to be supplied to the ink jet head 35, a head control board 34 which controls driving of the ink jet head 35, and the carriage 17 in which these components and members are mounted. The ink jet head 35 includes a passage unit 32 having a plurality of liquid chambers through which ink supplied from each buffer tank 18 is guided to a number of nozzles (not shown), and a piezoelectric actuator 33 which is laminated on an upper surface of the passage unit 32 to selectively apply an ejecting pressure to the ink in the passage unit 32 toward the nozzles.

The cartridge mounting portion 19 is disposed inside the cover 8. The four ink cartridges 20A to 20D are removably mounted to the cartridge mounting portion 19. The ink cartridges 20A to 20D are respectively coupled to the buffer tanks 18 via the cartridge mounting portion 19 and the ink supply tubes 21.

The ink cartridges 20A to 20D are each configured to be subjected to a force to be extended in a forward and rearward direction as described later. The cartridge mounting portion 19 is provided with four locking devices 38 described later respectively corresponding to the four ink cartridges 20A to 20D. The locking devices 38 are configured to lock the ink cartridges 20A to 20D in their contracted states. In addition, the cartridge mounting portion 19 is provided with four ink amount sensors 37 to respectively correspond to the four ink cartridges 20A to 20D. Each ink amount sensor 37 serves to optically detect the amount of ink stored in the associated one of the ink cartridges 20A to 20D mounted to the cartridge mounting portion 19.

A controller 40 is communicatively coupled to an actuator 83 (FIG. 4), the ink amount sensor 37, and a head control board 34 of each ink cartridge. The controller 40 includes a CPU which is a calculating unit, a ROM which stores programs being run by the CPU and data used for the programs, a RAM which temporarily stores data when the program is being run, a rewritable memory such as an EEPROM, and an input/output interface. From a functional point of view, the controller 40 includes a calculation control section 41 which executes required calculation control, an ink amount detecting section 42 which detects a remaining amount of ink in each of the ink cartridges 20A to 20D based on information from the ink amount sensors 37 and the head control board 34, a user input section 43 which receives an input signal generated in response to the user's operation, and a drive section 44 which drives the actuator 83 to perform an unlocking operation of the corresponding locking device 38. The ink amount sensor 37 and the ink amount detecting sensor 42 form an ink amount detector for each ink cartridge.

Figure 4:
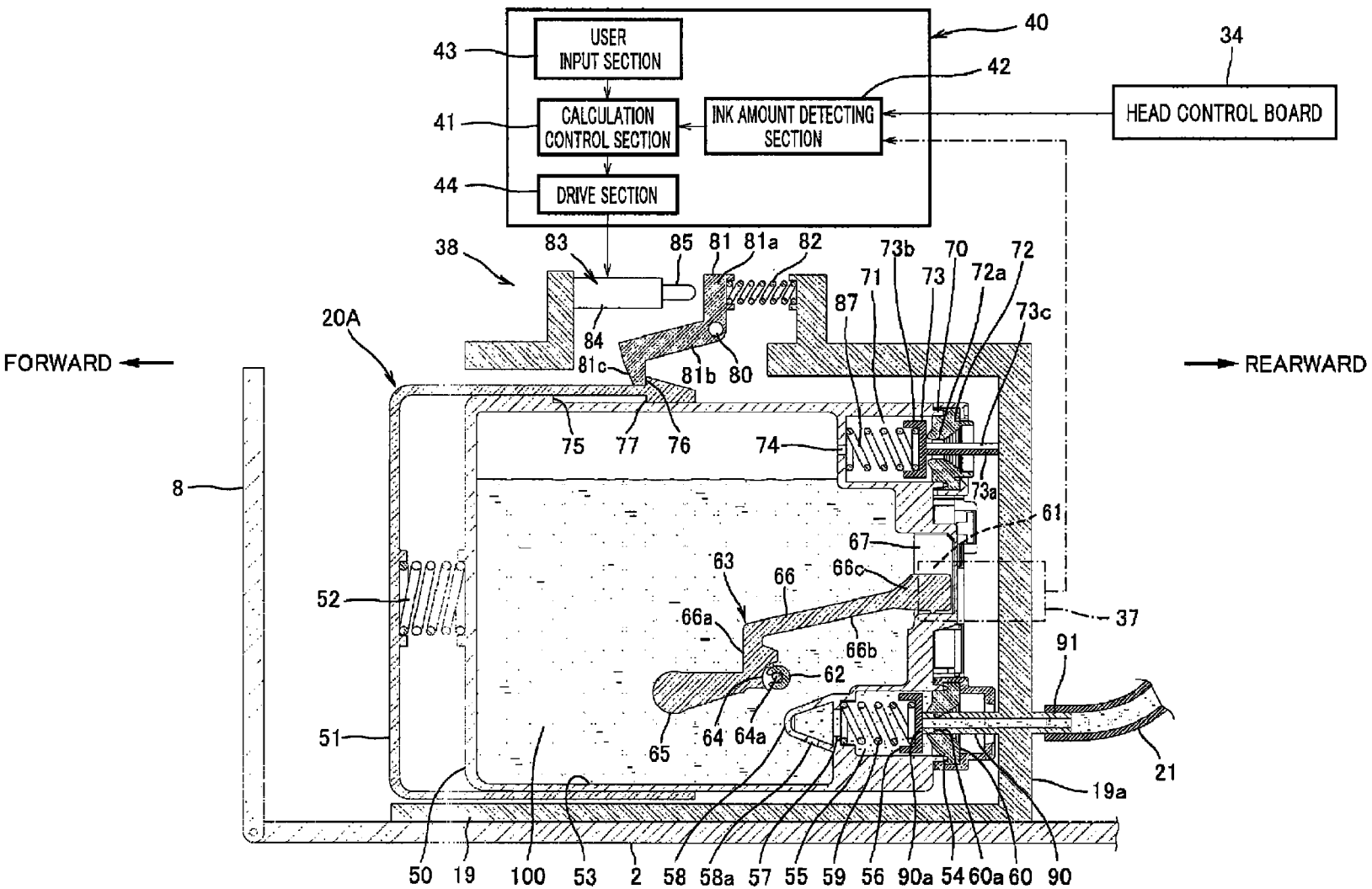
FIG. 4 is a vertical sectional view showing a region in the vicinity of an ink cartridge mounted to the ink jet printer of FIG. 3.

FIG. 4 is a vertical sectional view showing a region in the vicinity of an ink cartridge 20A mounted to the ink jet printer 3 of FIG. 3. Since the ink cartridges 20A to 20D and their associated components have the same structure, the following description will be made based on the ink cartridge 20A.

Referring to FIG. 4, the ink cartridge 20A includes a first unit 50 having an ink storing chamber 53 for storing ink 100, a second unit 51 slidably attached to the first unit 50 at a location close to the cover 8, and a coil spring (biasing member) 52 which is mounted between the first unit 50 and the second unit 51 and applies a force to cause the second unit 51 to move relative to the first unit 50 from a close position where the second unit 51 is close to the first unit 50 to a distant position where the second unit 51 is distant from the first unit 50.

An opening 54 and a tubular valve accommodating chamber 55 connected to the opening 54 are provided at a lower portion of the first unit 50 on a far side (right side in FIG. 4) from the cover 8. The valve accommodating chamber 55 extends from the opening 54 to the interior of the first unit 50. An ink supply valve 56 is accommodated in the valve accommodating chamber 55. An annular seal member 60 is positioned within the opening 54 and an ink outlet 60*a* is formed at a center of the opening 54. The ink supply valve 56 is subjected to a force applied from a spring 59 toward the seal member 60 so as to close the ink outlet 60*a*. A hole 57 is formed on a front surface of the valve accommodating chamber 55. A cover member 58 having a hollow conical shape protrudes from the periphery of the hole 57 to the interior of the first unit 50. An inlet hole 58*a* is formed at a lower portion of the cover member 58. The valve accommodating chamber 55 communicates with the ink storing chamber 53 via the valve hole 57 and the inlet hole 58*a*.

At a back wall portion 19*a* of the cartridge mounting portion 19 which vertically extends on the far side (right side in FIG. 4) from the cover 8, a tubular needle portion 90 protrudes toward the ink cartridge 20A, and a tip end of the needle portion 90 forms an ink inlet 90*a*. A tube mounting portion 91 protrudes from the back wall portion 19*a* on a side opposite from the needle portion 90 and is connected to the needle portion 90 via the back wall portion 19*a*. The ink supply tube 21 is coupled to the tube mounting portion 91 and the needle portion 90 is liquid-tightly inserted into the ink outlet 60*a* of the seal member 60 of the first unit 50 to push the ink supply valve 56 open. Thereby, the ink storing chamber 53 of the ink cartridge 20A is connected to the buffer tank 18.

An opening 70 and a tubular valve accommodating chamber 71 connected to the opening 70 are provided at an upper portion of the first unit 50 on the far side (right side in FIG. 4) from the cover 8. An annular seal member 72 is positioned within the opening 70. The seal member 72 has an air release hole 72*a* at a center thereof. The valve accommodating chamber 71 extends from the opening 70 to the interior of the first unit 50. An air release valve 73 is accommodated in the valve accommodating chamber 71. The air release valve 73 includes a rod portion 73*a* protruding through the air release hole 72*a* toward the back wall portion 19*a* of the cartridge mounting portion 19 and a flange portion 73*b* protruding radially outward from a front end portion of the rod member 73*a*. The air release valve 73 is subjected to a force applied from a spring 87 so that the flange portion 73*b* contacts the seal member 72 to seal the air release hole 72*a*. A groove 73*c* is formed on the rod portion 73*a* to extend in a direction in which the rod portion 73*a* extends. In a state where the flange portion 73*b* is away from the seal member 72, the valve accommodating chamber 71 is opened to the atmosphere via the groove 73*c*. A communicating hole 74 is formed at a front surface of the valve accommodating chamber 71. The valve accommodating chamber 71 communicates with an air layer formed in an upper layer of the ink accommodating chamber 53 via the communicating hole 74.

The second unit 51 is externally fitted to the first unit 50 from the direction of the cover 8 such that the second unit 51 is slidable relative to the first unit 50. A claw-shaped locked portion 76 is formed on an upper wall portion of the second unit 51 so as to protrude upward. In addition, a stopper portion 77 is formed on the upper wall portion of the second unit 51 so as to protrude downward. When the second unit 51 slides relative to the first unit 50 toward the cover 8 under the force applied from the spring 52, the stopper portion 77 comes in contact with a protruding portion 75 formed on an upper surface of the first unit 51 which is located on a side closer to the cover 8, thus preventing disengagement of the second unit 51 from the first unit 50.

The locking device 38 is disposed in an upper portion of the ink cartridge 20A and includes a lever-like locking member 81 pivotally supported by a pivot shaft 80, and a coil spring 82 which applies a force to cause the locking member 81 to be in a locking state. The locking member 81 includes a first arm portion 81*a* protruding upward from the pivot shaft 80, a second arm portion 81*b* protruding forward (toward the cover 8) from the pivot shaft 80, and a locking portion 81*c* protruding downward from a tip end of the second arm portion 81*b*. One end portion of the spring 82 is coupled to the cartridge mounting portion 19 and the other end portion thereof is coupled to the first arm portion 81*a*. The spring 82 applies a force to cause the locking member 81 to be pivotable counterclockwise of FIG. 4 around the pivot shaft 80 so that the locking portion 81*c* of the locking member 81 is locked with respect to the locked portion 76 of the second unit 51 in a state where the second unit 51 is close to the first unit 50 against the spring 52.

A solenoid type actuator 83 is disposed in an upper portion of the cartridge mounting portion 19 so as to oppose the first arm portion 81*a* on the opposite side of the spring 82. The actuator 83 is configured to operate the locking device 38 to cause the locking member 81 to turn to an unlocking state. The actuator 83 includes a solenoid portion 84 coupled to the drive section 44 of the controller 40 and a rod portion 85 which is extendable from the solenoid portion 84 toward the first arm portion 81*a* and retractable away from the first arm portion 81*a*. To be more specific, the rod portion 85 of the actuator 83 moves to press the first arm portion 81*a* against the spring 82, causing the locking member 81 to be pivoted clockwise of FIG. 4 around the pivot shaft 80. Thereby, the locking state between the locking portion 81*c* and the locked portion 76 is released. A clearance is provided between the cover 8 and the ink cartridge 20A to avoid that the ink cartridge 20A interferes with the cover 8 in the state where the second unit 51 is protruding toward the cover 8 under the force applied from the spring 52.

When a force of the seal member 60 for holding the needle portion 90 at the ink outlet 60*a* is Fp, a force for causing the second unit 51 to move the first unit 50 together with the second unit 51 away from the needle portion 90 when the second unit 51 is unlocked with respect to the locking member 81 and slides under the force applied from the spring 52 is F1, and a force of the spring 59 for pushing back the needle portion 90 is F2, the relationship F1+F2<Fp is established. Therefore, even when the second unit 51 is unlocked with respect to the locking member 81 and moves from the close position where the second unit 51 is close to the first unit 50 to the distant position where the second unit 51 is distant from the first unit 50, the seal member 60 keeps holding the needle portion 90, so that a coupling state between the ink outlet 60*a* and the ink inlet 90*a* is maintained.

A recessed portion 67 is provided at a portion of the first unit 50 on the back wall portion 19 side and is connected to the ink storing chamber 53. Light transmitting portions 61, which are made of a translucent material, are provided on both side walls of the recessed portion 67 to detect an amount of the ink stored in the ink storing chamber 53. The first unit 50 has a support portion 62 for pivotally supporting a sensor arm 63. The sensor arm 63 includes a coupling portion 64 having a coupling shaft 64*a* supported on the support portion 62, a float portion 65 extending on one side (left side of FIG. 4) of the coupling portion 64, and an arm portion 66 extending on an opposite side (right side of FIG. 4) of the coupling portion 64.

The float portion 65 is formed to have a hollow shape so that its average specific gravity is smaller than a specific gravity of the ink. The arm portion 66 includes a first arm 66*a*, a second arm 66*b*, and a blocking portion 66*c*. The first arm 66*a* extends from the coupling portion 64 upward in a direction generally perpendicular to the float portion 65. The second arm portion 66*b* extends from a tip end of the first arm 66*a* in a direction away from the float portion 65. The blocking portion 66*c* is formed at a tip end of the second arm portion 66*b* and is located in the recessed portion 67.

The arm portion 66 has a smaller weight than the float portion 65. In a state where no ink is stored in the ink storing chamber 53, the sensor arm 63 rotates around the coupling shaft 64*a* in a direction to cause the float portion 65 to move downward. In this case, the blocking portion 66*c* of the sensor arm 63 moves obliquely upward away from the recessed portion 67. On the other hand, in a state where the ink storing chamber 63 is sufficiently filled with the ink, the float portion 65 is immersed in the ink, and a weight balance between the float portion 65 and the arm portion 66 is reversed due to a buoyant force, so that the sensor arm 63 rotates around the coupling shaft 64*a* in a direction to cause the float portion 65 to move upward. In this case, the blocking portion 66*c* of the sensor arm 63 moves obliquely downward into the recessed portion 67.

Figure 5:
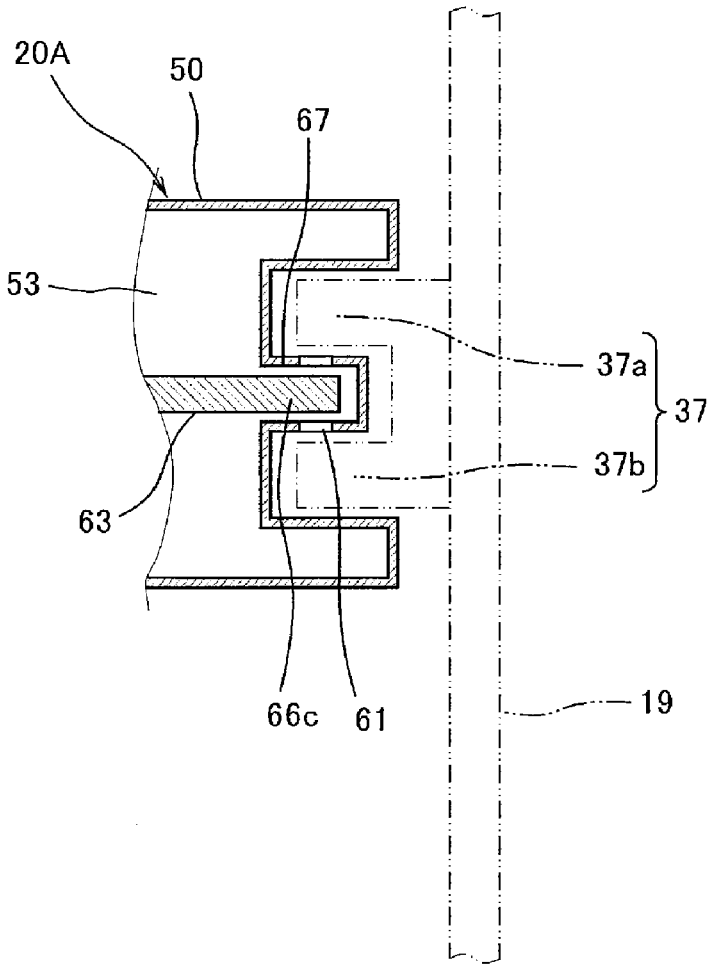
FIG. 5 is a horizontal sectional view showing major components of the cartridge and an ink amount sensor of FIG. 4.

FIG. 5 is a horizontal sectional view of major components of the ink cartridge 20A and the ink amount sensor 37 shown in FIG. 4. As shown in FIG. 5, the cartridge mounting portion 19 is provided with the ink amount sensor 37. The ink amount sensor 37 includes a light emitting portion 37*a* and a light receiving portion 37*b*, and is configured to output a predetermined electric signal based on a luminance of light emitted from the light emitting portion 37*a* to the light receiving portion 37*b*. To be specific, a transparent photo interrupter is used as the ink amount sensor 37. The ink amount sensor 37 is disposed in such a manner that the light transmitting portions 61 are positioned in a detecting area between the light emitting portion 37*a* and the light receiving portion 37*b*.

In the state where the blocking portion 66*c* of the sensor arm 63 moves into the recessed portion 67 and is sandwiched between the light transmitting portions 61, the light emitted from the light emitting portion 37*a* is blocked by the blocking portion 66*c* and is not sensed by the light receiving portion 37*b*. In this case, the ink amount detecting section 42 (see FIG. 4) of the controller 40 determines that the amount of the ink stored in the ink storing chamber 53 is more than a predetermined amount. On the other hand, in the state where the blocking portion 66*c* of the sensor arm 63 moves away from the recessed portion 67 and is not sandwiched between the light transmitting portions 61, the light emitted from the light emitting portion 37*a* is not blocked by the blocking portion 66*c* and is sensed by the light receiving portion 37*b*. In this case, the ink amount detecting section 42 (see FIG. 4) of the controller 40 determines that the amount of the ink stored in the ink storing chamber 53 is the predetermined amount or less.

Subsequently, an operation of the ink jet printer 3 will be described. In the state shown in FIG. 4, the ink storing chamber 53 contains a sufficient amount of ink. As the float portion 65 of the sensor arm 63 moves upward, the blocking portion 66*c* of the sensor arm 63 moves into the recessed portion 67 and is sandwiched between the light transmitting portions 61. Therefore, in this case, the ink amount detecting section 42 (see FIG. 4) of the controller 40 determines that the amount of the ink stored in the ink storing chamber 53 is more than the predetermined amount.

When the ink inside the ink cartridge 20A is reduced to the predetermined amount, the float portion 65 of the sensor arm 63 moves downward and the blocking portion 66*c* moves away from the recessed portion 67. Therefore, in this case, the ink amount detecting section 42 of the controller 40 determines that the amount of the ink stored in the ink storing chamber 53 is the predetermined amount or less, based on the signal from the ink amount sensor 37. From this time point, the ink amount detecting section 42 calculates a cumulative amount of ink to be ejected from the ink jet head 32 (see FIG. 3) based on the data received from the head control board 34, and thus calculates the amount of ink remaining in the ink storing chamber 53. Based on calculation data, the ink amount detecting section 42 determines that the amount of ink inside the ink storing chamber 53 is zero at the time point when the ink inside the ink storing chamber 53 is reduced to an extent at which a liquid level of the ink reaches the inlet hole 58*a*.

Figure 6:
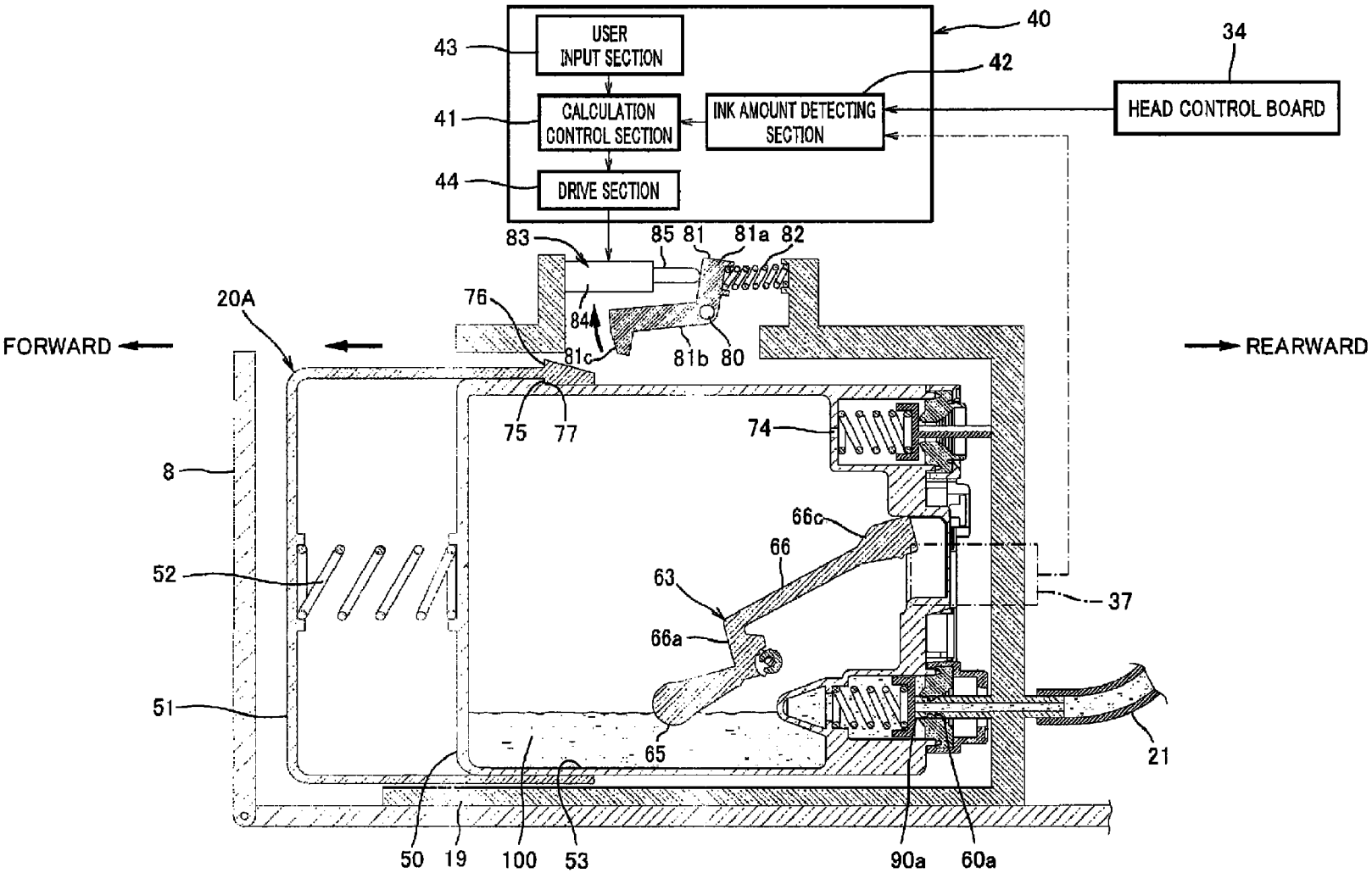
FIG. 6 is a vertical sectional view showing a region in the vicinity of the ink cartridge of FIG. 4, in a state where the ink cartridge is empty.
Figure 7:
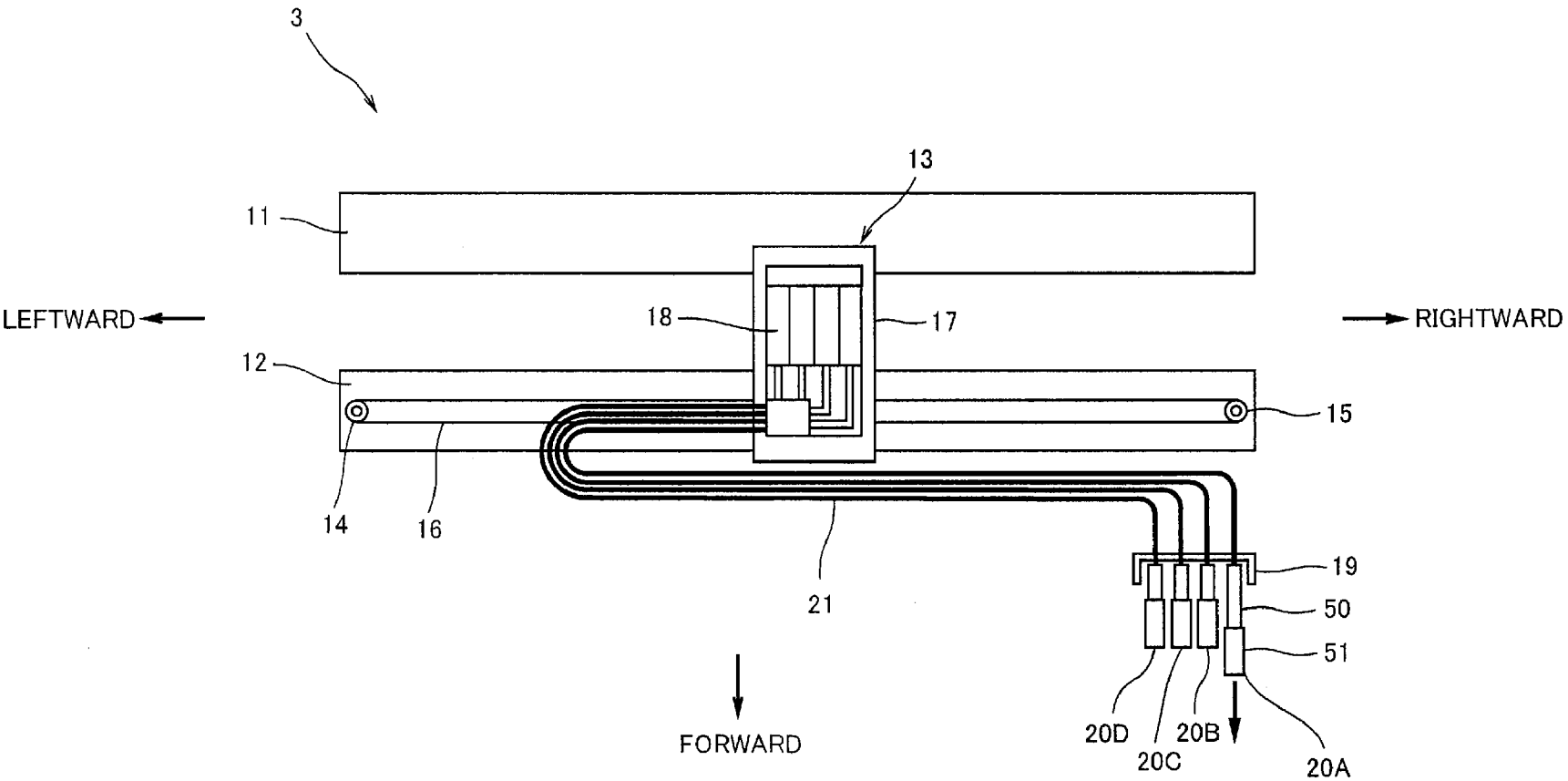
FIG. 7 is a plan view showing a state where one ink cartridge in the ink jet printer of FIG. 2 is empty.

FIG. 6 is a vertical sectional view showing a state where the ink cartridge 20A is empty. FIG. 7 is a plan view showing a state where the ink cartridge 20A is empty. Turning to FIG. 6, when the ink amount detecting section 42 determines that the amount of ink inside the ink cartridge 20A is zero, it sends an EMPTY signal to the calculation control section 41. Receiving the EMPTY signal, the calculation control section 41 instructs the drive section 44 to extend the rod portion 85 of the actuator 83 corresponding to the empty ink cartridge 20A. Then, the locking member 81 is pivoted clockwise against the spring 82, causing only the locking portion 81*c* corresponding to the empty ink cartridge 20A to be unlocked with respect to the locked portion 76. Thereby, the second unit 51 moves relative to the first unit 50 toward the cover 8 under the force applied from the spring 52, so that an outer shape of the ink cartridge 20A is changed. To be specific, the second unit 51 slides away from the ink inlet 90*a* (see FIG. 7) in the state where the ink outlet 60*a* of the first unit 50 of the ink cartridge 20A is maintained to be coupled to the ink inlet 90*a* of the cartridge mounting portion 19. In this case, since a force for coupling the ink outlet 60*a* and the ink inlet 90*a* to each other is larger than the force applied to the first unit 50 in the direction in which the second unit 51 slides away from the first unit 50 to the distant position under the force applied from the spring 52, the coupling state between the ink inlet 60*a* and the ink outlet 90*a* is maintained. The calculation control section 41 of the controller 40 has an empty auto-eject mode in which the calculation control section 41 causes the locking member 81 to turn to the unlocking state upon a reception of the EMPTY signal.

In addition, the calculation control section 41 of the controller 40 has a manual eject mode in which the calculation control section 41 causes the locking member 81 to turn to the unlocking state in response to the user's operation. For example, when the user operates a button (eject command generator) of the operation panel 10 (see FIG. 1) to give an eject command indicating that the ink cartridge 20A should be ejected, an input signal indicating the eject command signal is generated and received in the user input section 43 of the controller 40. Receiving the input signal, the calculation control section 41 instructs the drive section 44 to extend the rod portion 85 of the actuator 83 corresponding to the ink cartridge 20A specified by the user, causing the locking member 81 to turn to the unlocking state. The user' operation of the operation panel 10 or a personal computer (not shown) externally connected to the ink jet printer 1 or the like enables the empty auto-eject mode and manual eject mode to be switched.

In accordance with the above configuration, in the state where the ink outlet 60*a* of the ink cartridge 20A is coupled to the ink inlet 90*a* of the cartridge mounting portion 19, the electric control is executed so that the second unit 51 is moved relative to the first unit 50 under the force applied from the spring 52, thereby changing the outer shape of the ink cartridge 20A. This enables the user to visually check the ink cartridge 20A to be detached without opening the ink supply passage between the ink cartridge 20A and the cartridge mounting portion 19. As a result, the user is able to easily and surely change the ink cartridge 20A while preventing entry of air bubbles and foreign matter, such as dust, into the ink supply passage or falling of ink droplets.

In addition, when the second unit 51 slides away from the first unit 50, away from the cartridge mounting portion 19 and closer to the cover 8, it moves away from adjacent liquid cartridges 20B to 20D. Therefore, the user is able to easily grab and detach the empty ink cartridge 20A among from the plurality of ink cartridges 20A to 20D. Thus, efficiency of the operation for changing the ink cartridge can be increased.

The empty auto-eject mode and the manual eject mode may be switched by the user's operation, or may be executed simultaneously. Instead of the coil spring 52, any elastic member, which are able to apply a force to the second unit 51, such as a leaf spring or rubber member may be used. Furthermore, the controller 40 may be integral with the head control board 34, instead of being separate therefrom as illustrated in the first embodiment.

(Embodiment 2)

Figure 8:
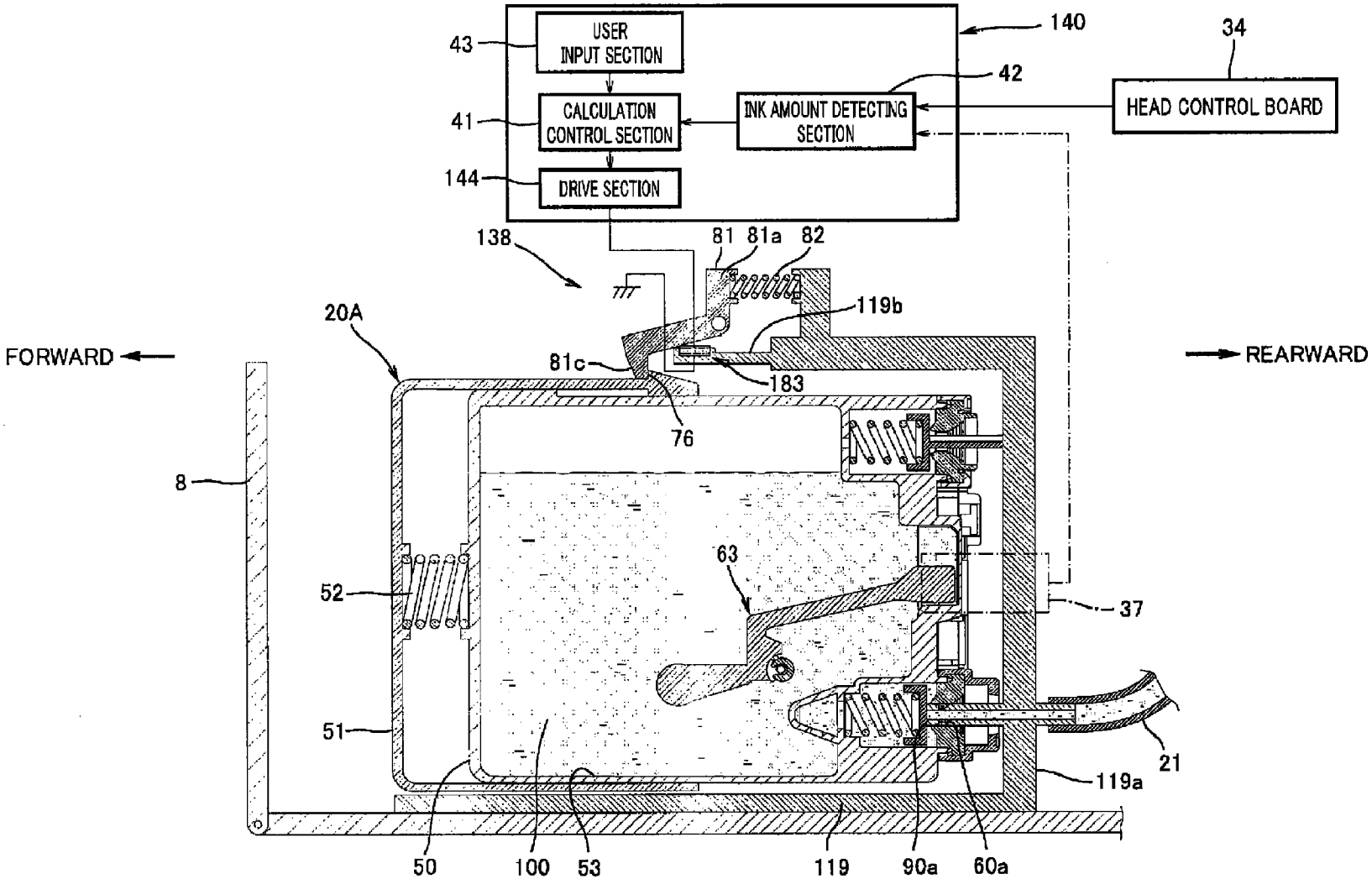
FIG. 8 is a vertical sectional view showing a region in the vicinity of an ink cartridge mounted to an ink jet printer according to a second embodiment of the present invention.
Figure 9:
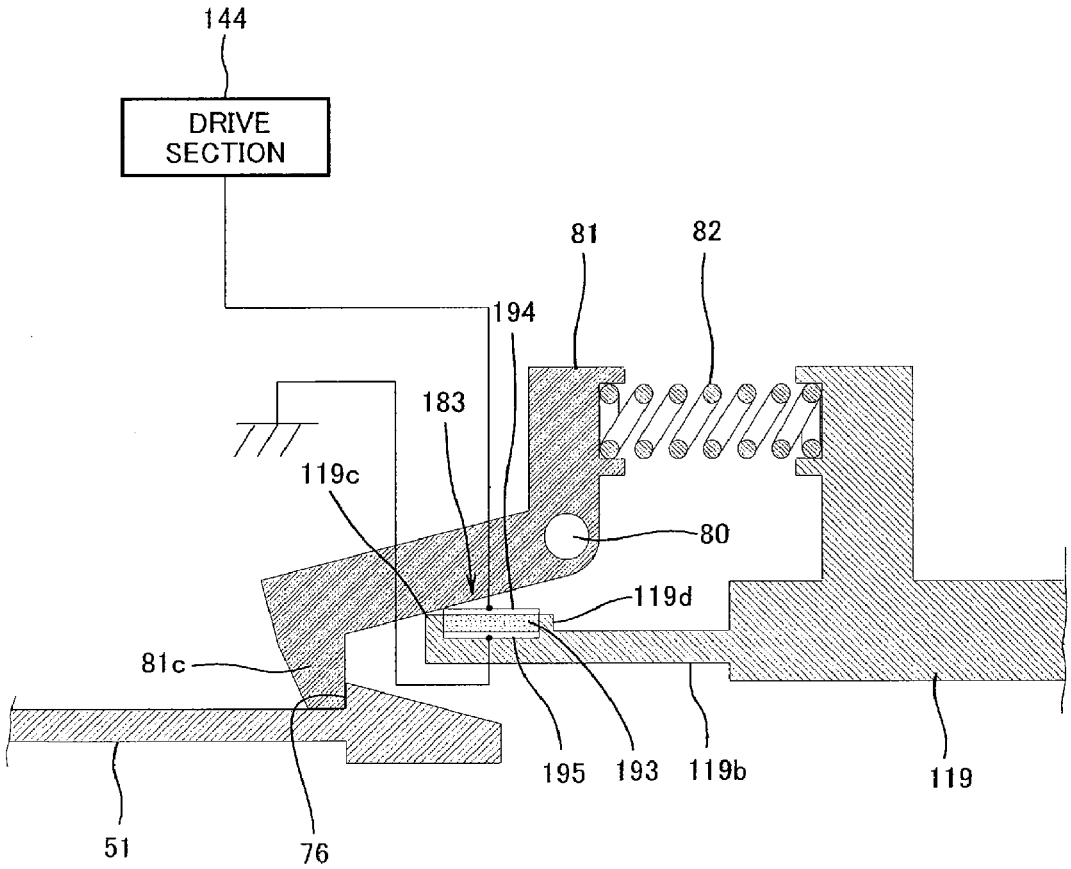
FIG. 9 is an enlarged view of major components in the ink jet printer of FIG. 8.

FIG. 8 is a vertical sectional view showing a region in the vicinity of the ink cartridge 20A mounted to an ink jet printer according to a second embodiment of the present invention. FIG. 9 is an enlarged view of major components in the ink jet printer of FIG. 8. The second embodiment is different from the first embodiment in that a dielectric elastomer 193 is used as an actuator 183. In the second embodiment, the same reference numerals as those in the first embodiment denote the same or corresponding parts which will not be further described.

Referring to FIGS. 8 and 9, a cartridge mounting portion 119 has a back wall portion 119*a* and an upper wall portion 119*b* protruding forward (toward the cover 8) from an upper end of the back wall portion 119*a*, and an actuator 183 is disposed on an upper surface of a front end portion of the upper wall portion 119*b*. The actuator 183 includes a flat dielectric elastomer 193, an upper electrode 194 formed on an upper surface of the dielectric elastomer 193, and a lower electrode 195 formed on a lower surface of the dielectric elastomer 193. The dielectric elastomer 193 is contracted in a direction of an electric field and is expanded in a direction perpendicular to the direction of the electric field. The dielectric elastomer 193 may be, for example, silicone based resin or acrylic based resin. The upper electrode 194 is electrically connected to a drive section 144 of a controller 140, while the lower electrode 195 is electrically grounded. Both end portions of the actuator 183 are restricted in position by protrusions 119*c* and 119*d* protruding upward from the upper wall portion 119*b*.

Figure 10:
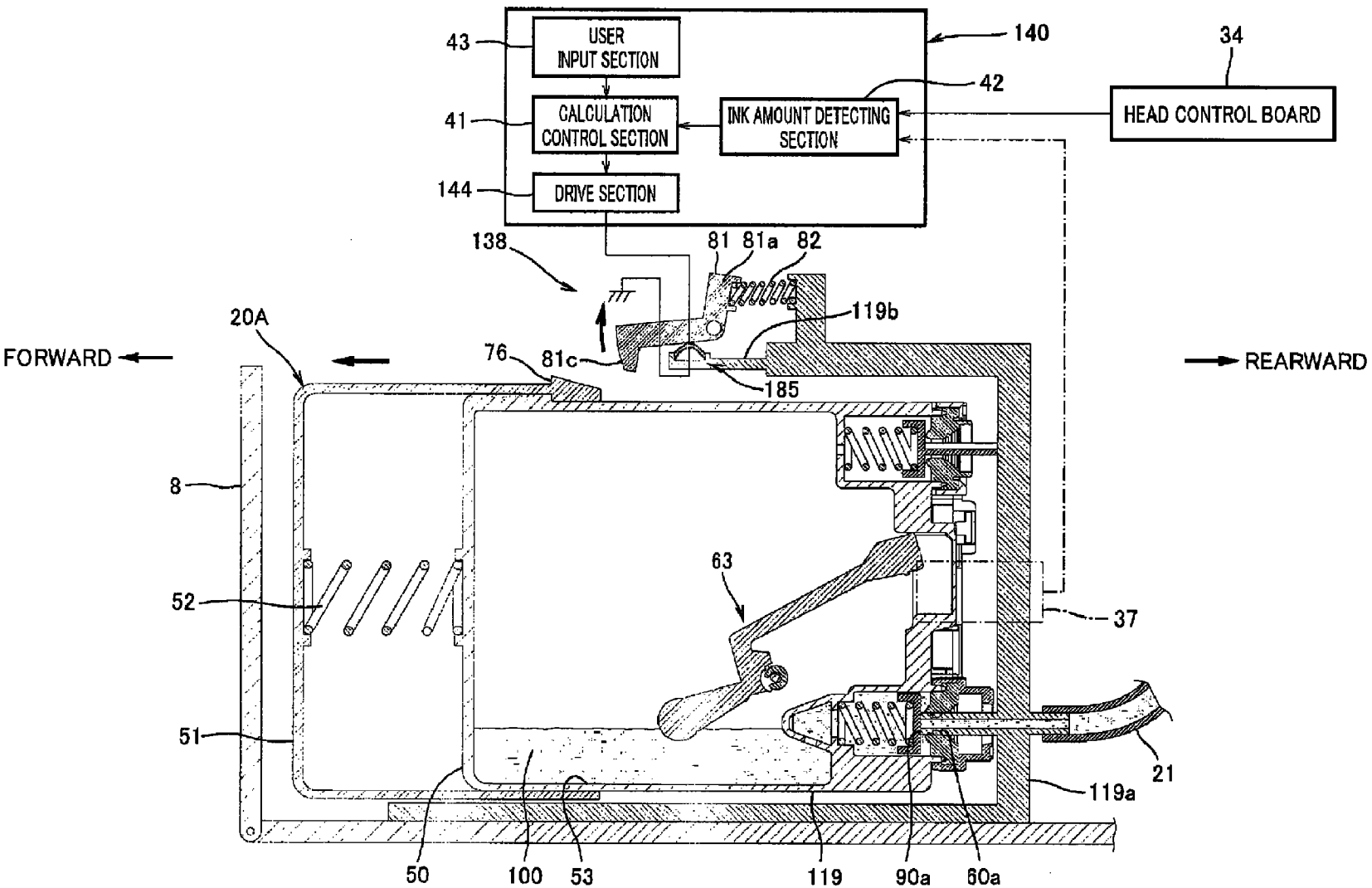
FIG. 10 is a vertical sectional view showing a region in the vicinity of the ink cartridge of FIG. 8, in a state where the ink cartridge is empty.
Figure 11:
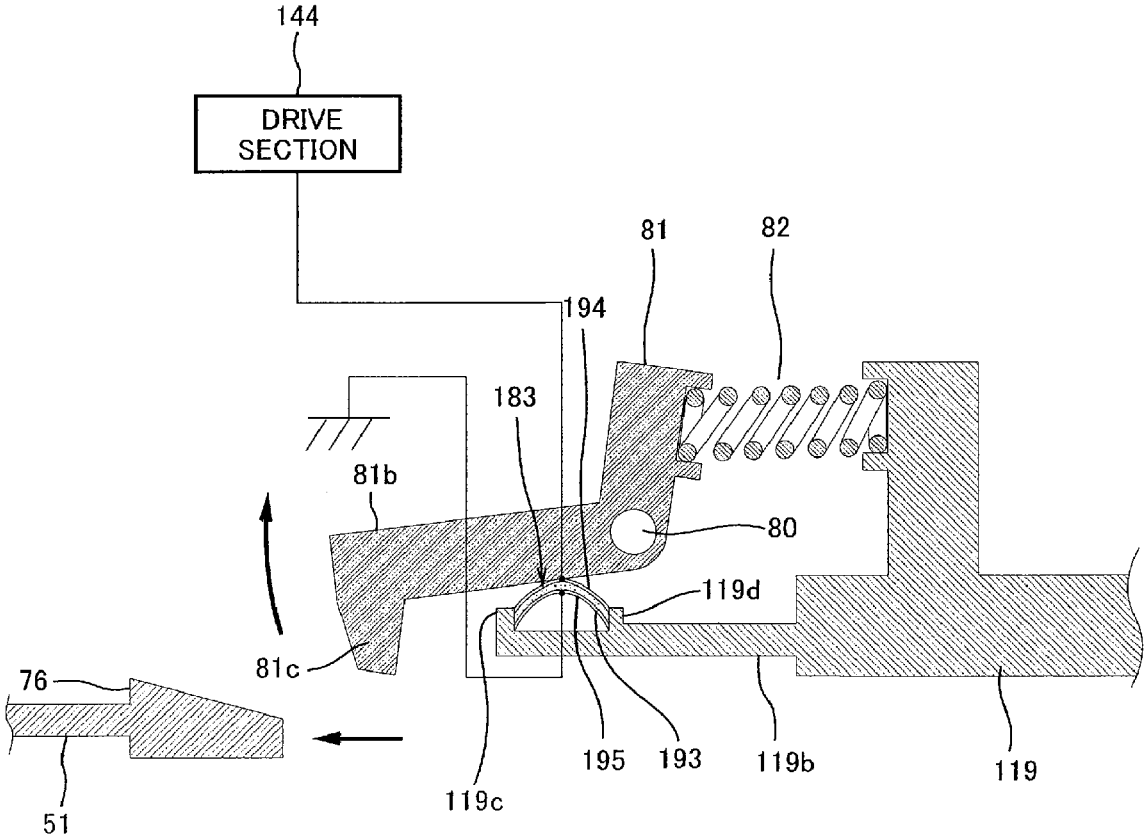
FIG. 11 is an enlarged view of major components in the ink jet printer of FIG. 10.

FIG. 10 is a vertical sectional view showing a region in the vicinity of the ink cartridge 20A of FIG. 8, in a state where the ink cartridge 20A is empty. FIG. 11 is an enlarged view of major components in the ink jet printer of FIG. 10. Referring to FIGS. 10 and 11, when the ink amount detecting section 42 detects that the amount of the ink stored in the ink cartridge 20A is zero, it sends an EMPTY signal (electric signal) to the calculation control section 41. Receiving the EMPTY signal, the calculation control section 41 instructs the drive section 144 to apply a voltage to the upper electrode 194 of the actuator 183 corresponding to the empty ink cartridge 20A. Thereby, the electric field is generated between the upper electrode 194 and the lower electrode 195, causing the dielectric elastomer 193 to be contracted in a thickness direction thereof (vertical direction). In this case, since the protrusions 119*c* and 119*d* restrict the expansion of the dielectric elastomer 193 in a direction perpendicular to the thickness direction, the dielectric elastomer 193 is deformed to protrude upward like a bow. Thereby, the dielectric elastomer 193 presses upward the second arm portion 81*b* of the locking member 81, causing the locking member 81 to be pivoted clockwise against the spring 82. Thus, the locking portion 81*c* is unlocked with respect to the locked portion 76. Under this condition, the second unit 51 moves toward the cover 8 relative to the first unit 50 under the force applied from the spring 52, so that the outer shape of the ink cartridge 20A is changed. In other words, in the state where the ink outlet 60*a* of the first unit 50 of the ink cartridge 20A is coupled to the ink inlet 90*a* of the cartridge mounting portion 119, the second unit 51 slides away from the ink inlet 90*a*.

In accordance with the above configuration, since the dielectric elastomer 193 is used as the actuator, the size of the ink jet printer can be reduced. In addition, the dielectric elastomer is deformed in larger amount as compared with a piezoelectric element and thus generates less heat. Therefore, the dielectric elastomer is suitably built into a high-density electric apparatus such as an ink jet printer.

(Embodiment 3)

Figure 12:
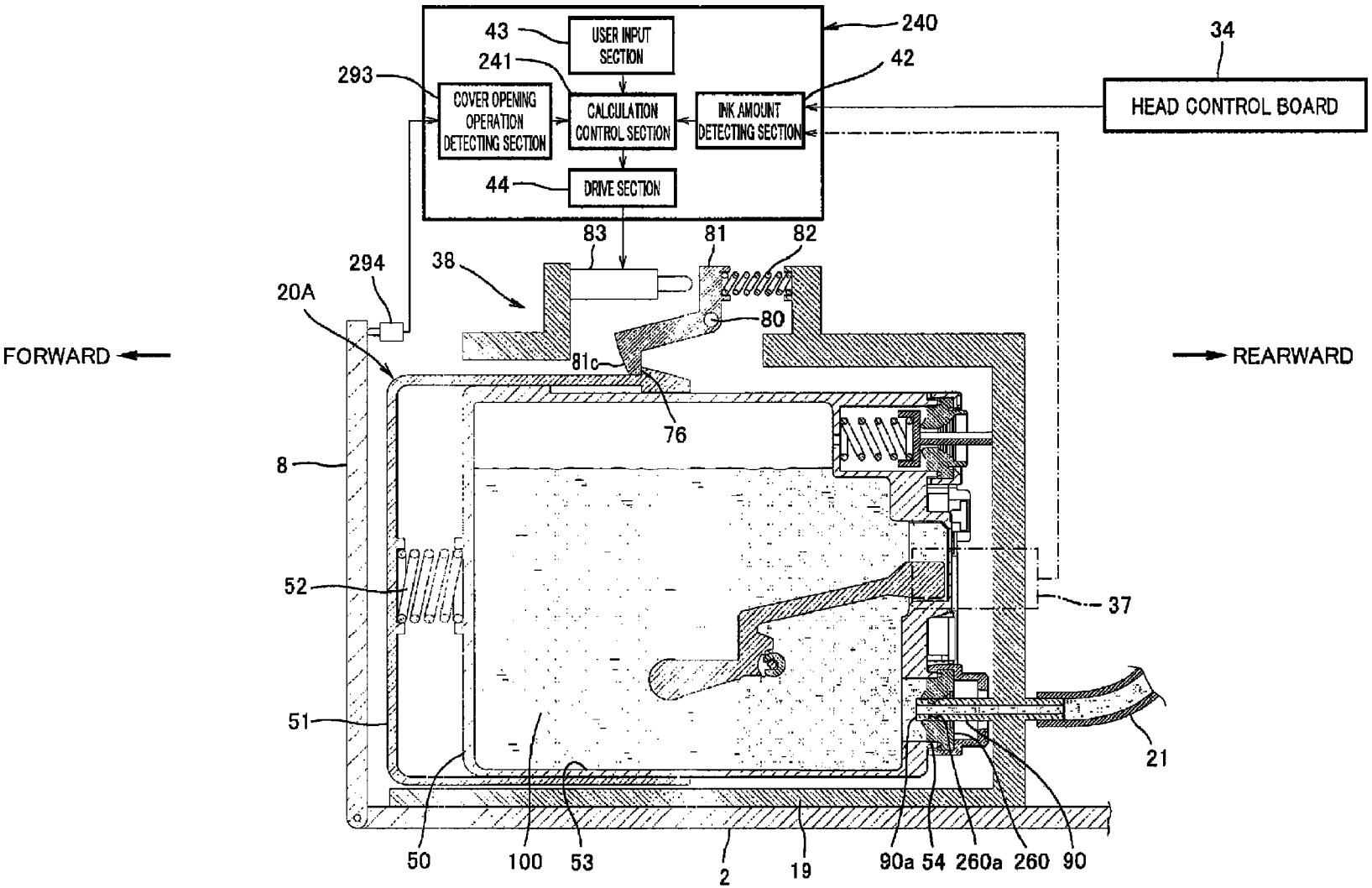
FIG. 12 is a vertical sectional view showing a region in the vicinity of an ink cartridge mounted to an ink jet printer according to a third embodiment of the present invention.

FIG. 12 is a vertical sectional view showing a region in the vicinity of the ink cartridge 20A mounted to an ink jet printer according to a third embodiment of the present invention. The third embodiment is different from the first embodiment in that the actuator 83 is controlled using an OPEN signal indicating that the cover 8 is open. In the third embodiment, the same reference numerals as those in the first embodiment denote the same or corresponding parts which will not be further described.

Referring to FIG. 12, the cartridge mounting portion 19 is positioned so that the second unit 51 is close to the cover 8 in the state where the ink cartridge 20A is mounted to the cartridge mounting portion 19. A cover opening operation detecting switch 294 is provided which is configured to detect whether the cover 8 is open or closed. A controller 240 includes a cover opening operation detecting section 293 coupled to the cover opening operation detecting switch 294. The cover opening operation detecting section 293 determines that the cover 8 is closed when it detects that the cover 8 is in contact with the cover opening operation detecting switch 294, while the cover opening operation detecting section 293 determines that the cover 8 is open when it detects that the cover 8 is not in contact with the cover opening operation detecting switch 294. That is, the cover opening operation detecting section 293 and the cover opening operation detecting switch 294 form a cover opening operation detector.

An annular seal member 260 is positioned within the opening 54 that is formed on the lower portion of the first unit 50 which is on the far side (right side in FIG. 4) from the cover 8. An ink outlet 260*a* is formed at a center of the seal member 260 and is configured to be elastically contracted to be closed at no load. In a state where the needle portion 90 of the cartridge mounting portion 19 is inserted into the ink outlet 260*a*, the ink inlet 90*a* of the needle portion 90 is connected to the ink storing chamber 53.

When a force of the seal member 260 for holding the needle portion 90 at the ink outlet 60*a* is Fp, and a force for causing the second unit 51 to move the first unit 50 together with the second unit 51 away from the needle portion 90 when the second unit 51 is unlocked with respect to the locking member 81 and slides under the force applied from the spring 52 is F1, the relationship F1<Fp is established. Therefore, even when the second unit 51 is unlocked with respect to the locking member 81 and slides from the close position where the second unit 51 is close to the first unit 50 to the distant position where the second unit 51 is distant from the first unit 50, the seal member 260 keeps holding the needle portion 90, so that a coupling state between the ink outlet 260*a* and the ink inlet 90*a* is maintained.

Figure 13:
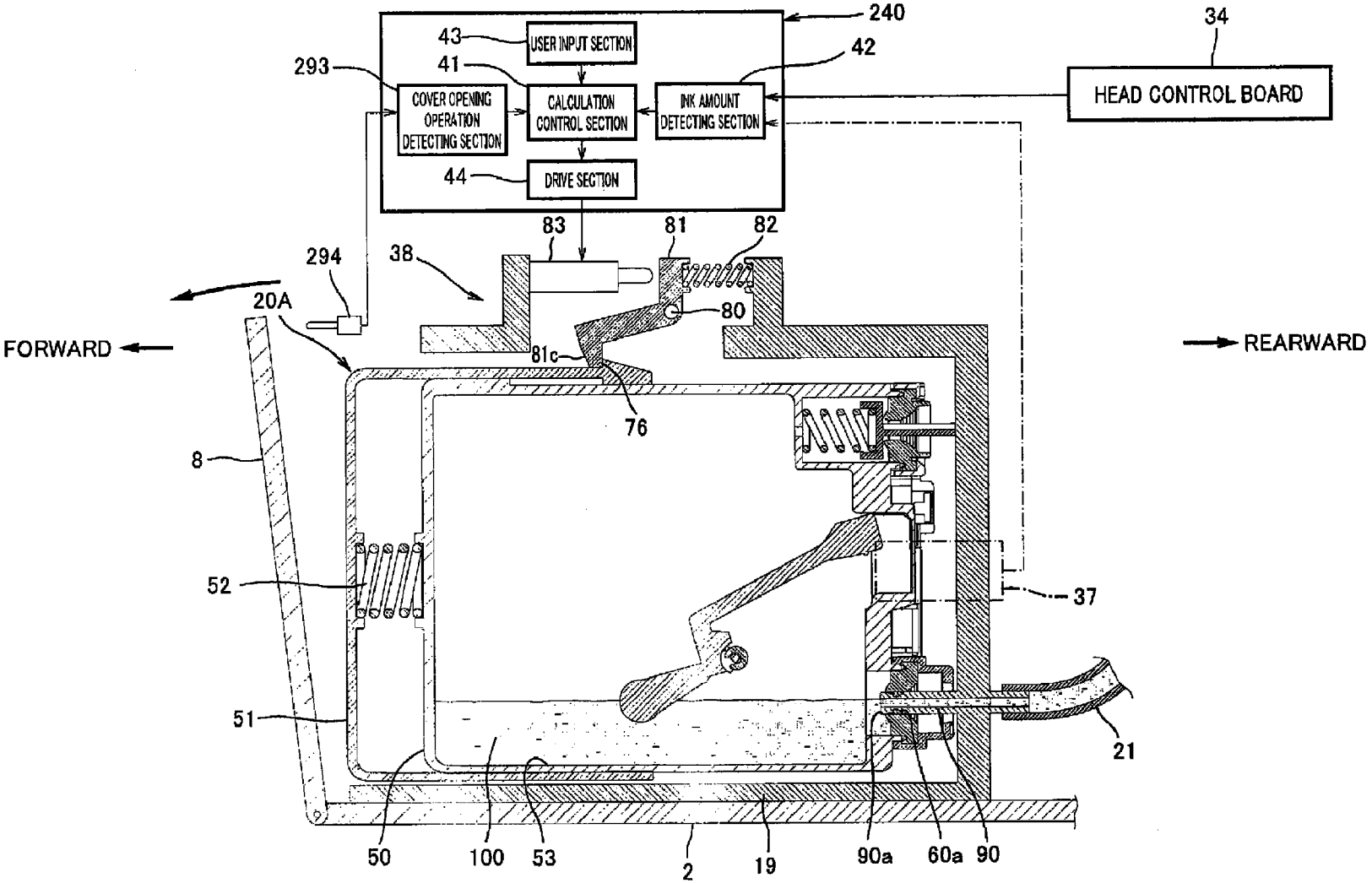
FIG. 13 is a vertical sectional view showing the region in the vicinity of the ink cartridge of FIG. 12 during an opening operation of a cover.

FIG. 13 is a vertical sectional view showing the region in the vicinity of the ink cartridge 20A of FIG. 12 during the opening operation of the cover 8. Referring to FIG. 13, when the ink amount detecting section 42 detects that the amount of ink stored in the cartridge 20A is zero, it sends to a calculation control section 241 an EMPTY signal indicating that the amount of ink is zero. When the user opens the cover 8, the cover opening operation detecting section 293 detects that the cover 8 is open and sends an OPEN signal to the calculation control section 241.

Figure 14:
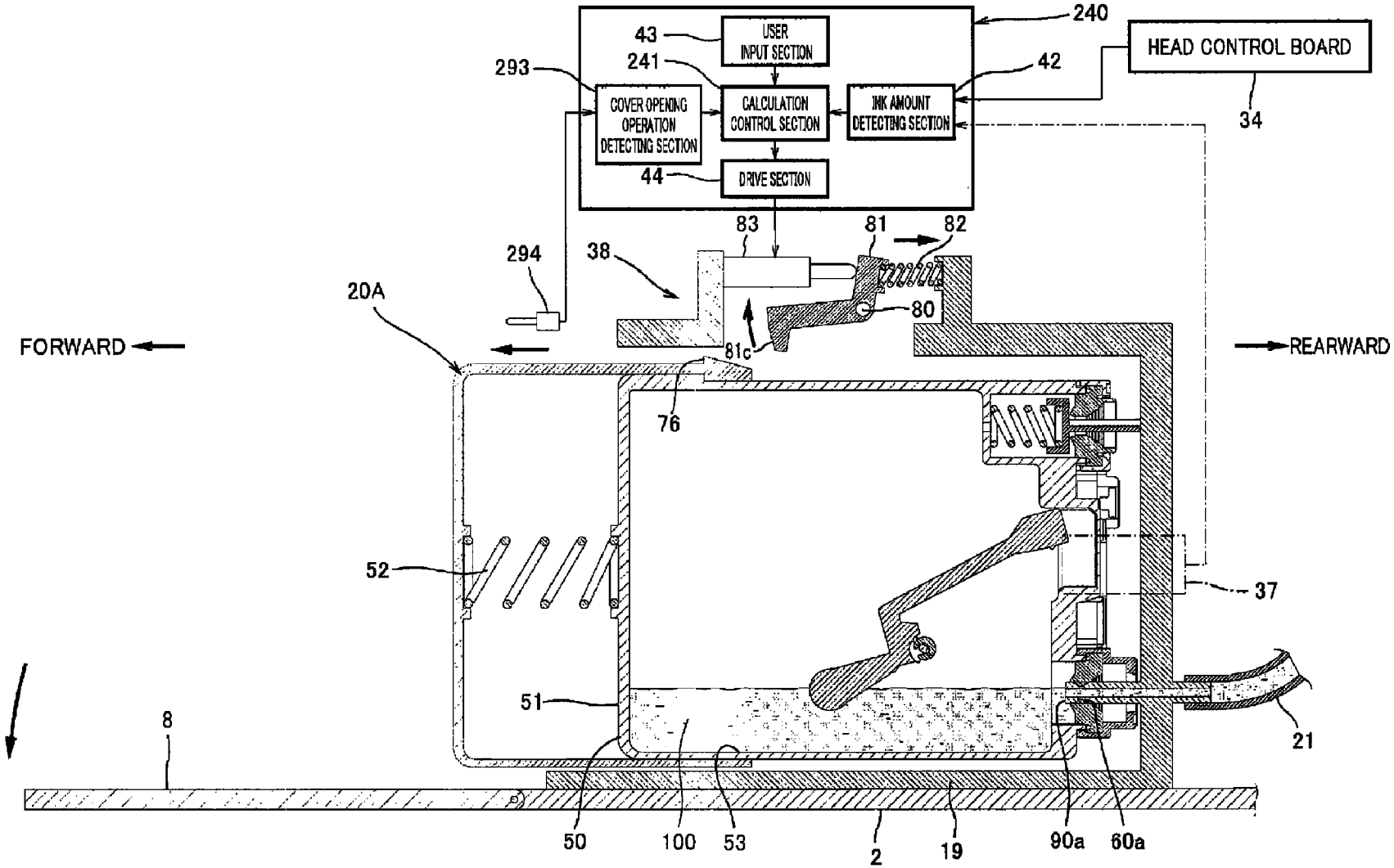
FIG. 14 is a vertical sectional view showing the region in the vicinity of the ink cartridge of FIG. 12 after completion of the opening operation of the cover.

FIG. 14 is a vertical sectional view showing the region in the vicinity of the ink cartridge 20A of FIG. 12 after completion of the opening operation of the cover 8. Referring to FIG. 14, receiving the EMPTY signal and the OPEN signal, the calculation control section 241 of the controller 240 instructs the drive section 44 to extend the rod portion 85 of the actuator 83 corresponding to the empty ink cartridge 20A, after a lapse of a specified time (e.g., one second). Then, the locking portion 81*c* and the locked portion 76 turn to be unlocked. Thereby, in the state where the ink outlet 60*a* of the first unit 50 is coupled to the ink inlet 90*a* of the cartridge mounting portion 19, the second unit 51 slides away from the first unit 50 under the force applied from the spring 52, and protrudes outward farther than the cover 8 in the closed position.

In accordance with the above described configuration, when the ink cartridge 20A is empty and the user opens the cover 8, the second unit 51 moves relative to the first unit 50. Therefore, it becomes possible to avoid that the user inadvertently pulls out the wrong ink cartridge which is not empty and to effectively prevent entry of air bubbles or foreign matter, such as dust, or falling of liquid droplets. In addition, after the cover 8 is opened, the second unit 51 slides. This makes it possible to dispose the cartridge mounting portion 19 closer to the cover 8. As a result, the size of the ink jet printer can be reduced.

(Embodiment 4)

Figure 15:
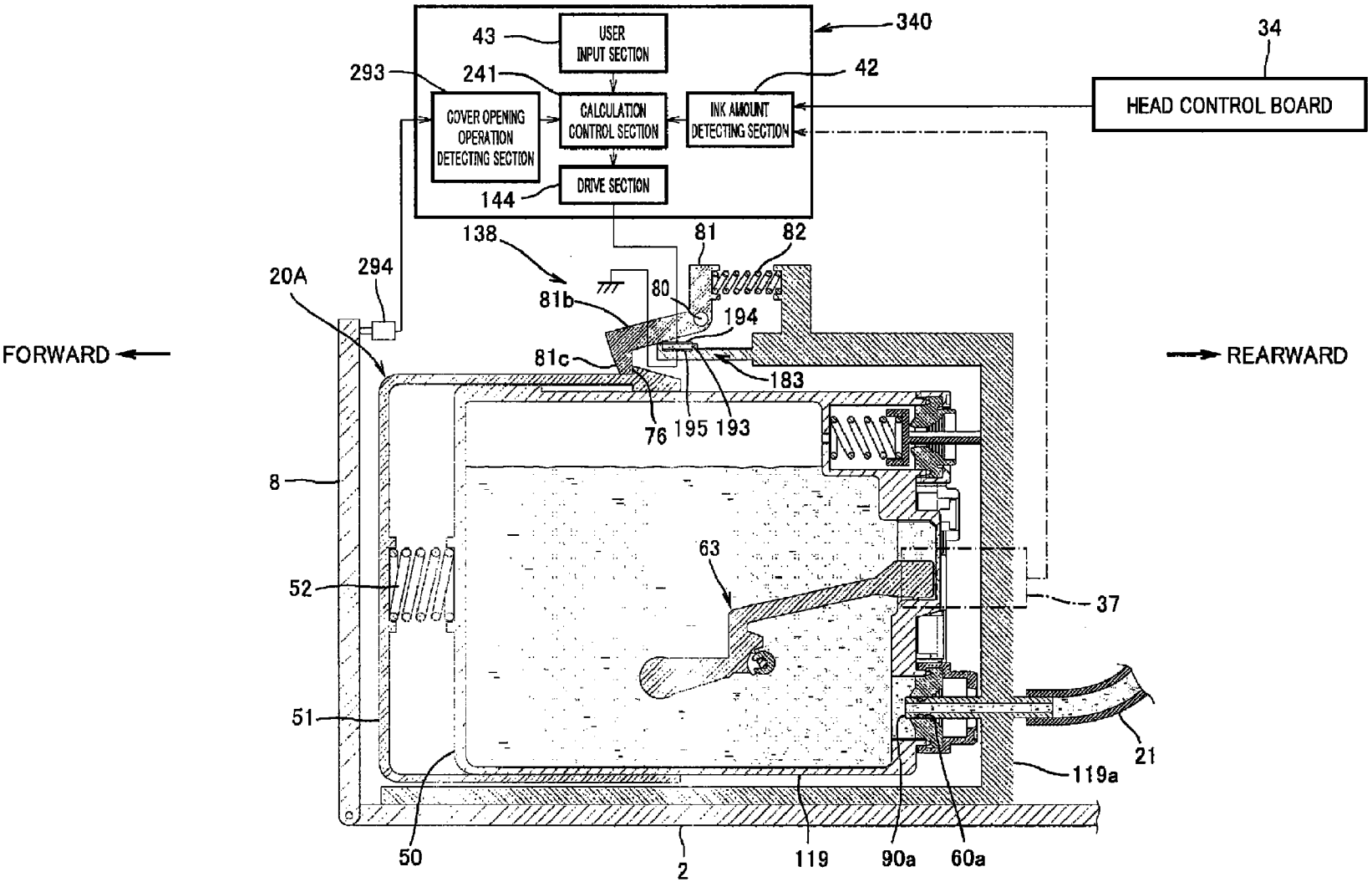
FIG. 15 is a vertical sectional view showing a region in the vicinity of an ink cartridge mounted to an ink jet printer according to a fourth embodiment of the present invention.

FIG. 15 is a vertical sectional view showing a region in the vicinity of the ink cartridge 20A mounted to an ink jet printer according to a fourth embodiment of the present invention. The fourth embodiment is different from the second embodiment in that the actuator 183 is controlled using an OPEN signal indicating that the cover 8 is open and is different from the third embodiment in that the dielectric elastomer 193 is used as the actuator 183. In the fourth embodiment, the same reference numerals as those in the first to third embodiments denote the same or corresponding parts which will not be further described.

Referring to FIG. 15, as in the third embodiment, the cartridge mounting portion 119 is positioned so that the second unit 51 is close to the cover 8 in the state where the ink cartridge 20A is mounted to the cartridge mounting portion 119. Also, as in the third embodiment, the cover opening operation detecting section 293 and the cover opening operation detecting switch 294, forming the cover opening operation detector, are provided. Furthermore, as in the second embodiment, the actuator 183 includes the thin-film dielectric elastomer 193, the upper electrode 194 formed on the upper surface of the dielectric elastomer 193, and the lower electrode 195 formed on the lower surface of the dielectric elastomer 193.

Figure 16:
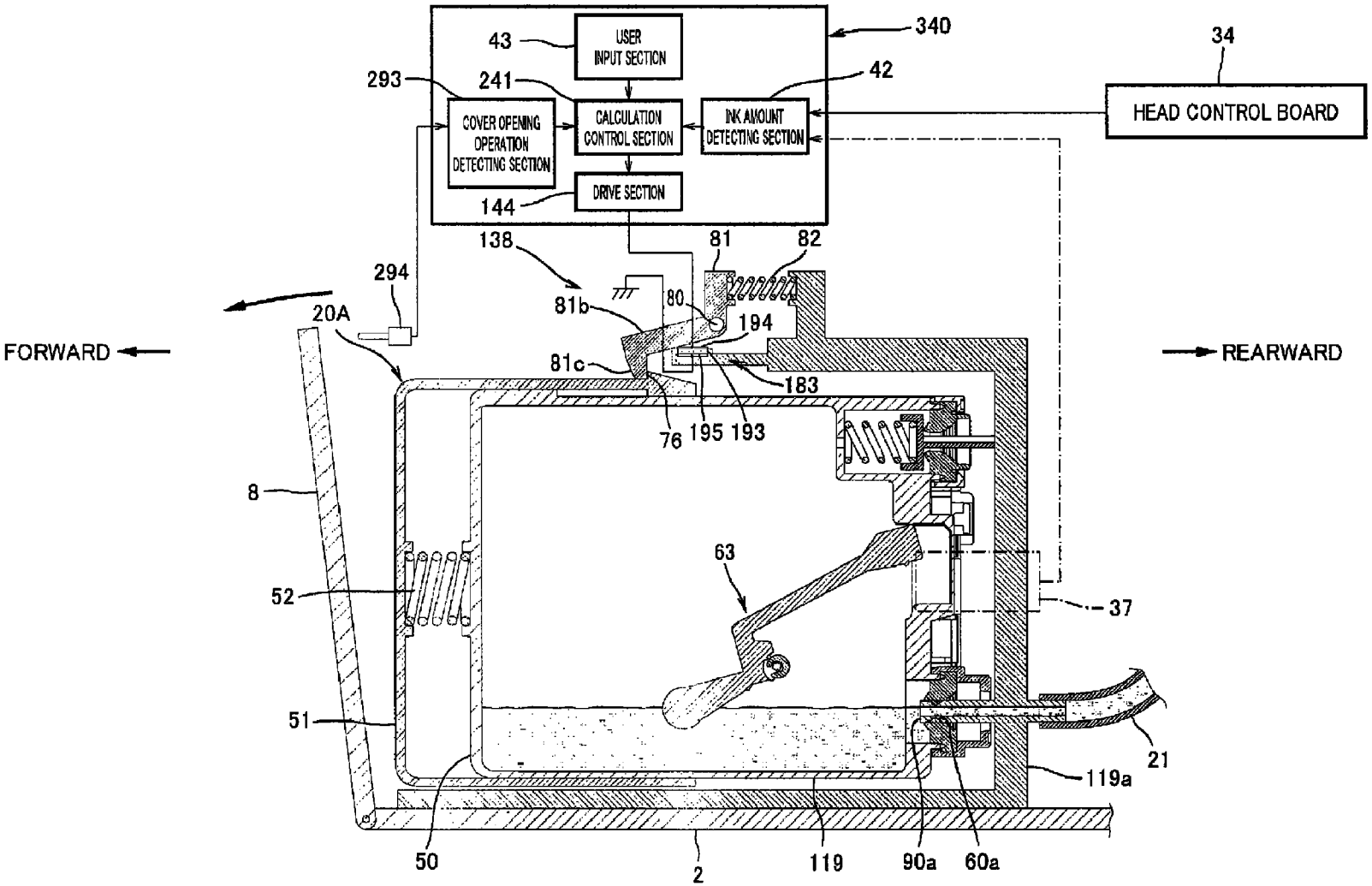
FIG. 16 is a vertical sectional view showing the region in the vicinity of the ink cartridge of FIG. 15 during the opening operation of the cover.

FIG. 16 is a vertical sectional view showing the region in the vicinity of the ink cartridge 20A of FIG. 15 during the opening operation of the cover 8. Referring to FIG. 16, when the ink amount detecting section 42 detects that the amount of the ink stored in the cartridge 20A is zero, it sends to the calculation control section 241 an EMPTY signal indicating that the amount of ink is zero. When the user opens the cover 8, the cover opening operation detecting section 293 detects that the cover 8 is open and sends an OPEN signal to the calculation control section 241.

Figure 17:
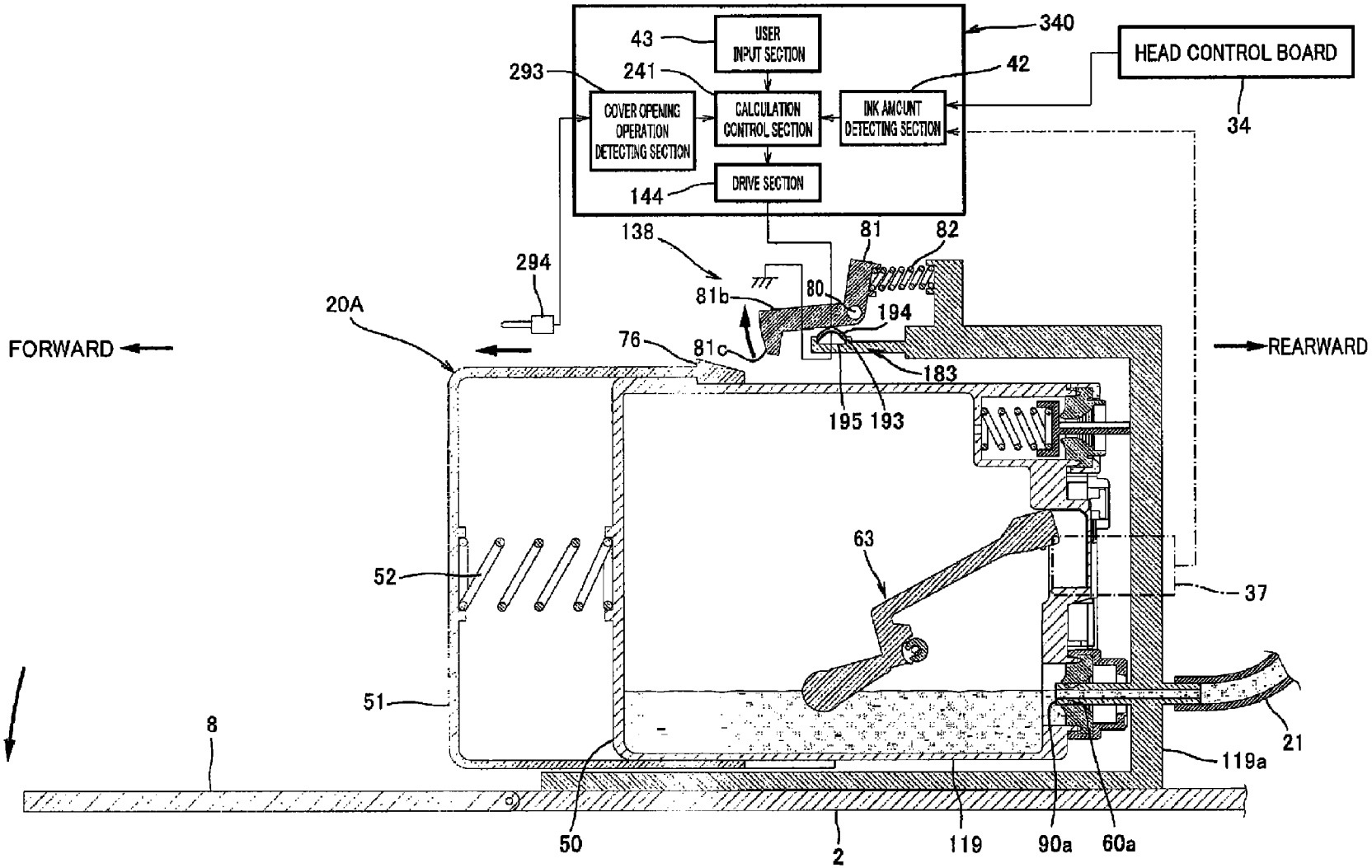
FIG. 17 is a vertical sectional view showing the region in the vicinity of the ink cartridge of FIG. 15 after completion of the opening operation of the cover.

FIG. 17 is a vertical sectional view showing the region in the vicinity of the ink cartridge 20A of FIG. 15 after completion of the opening operation of the cover 8. Referring to FIG. 17, receiving the EMPTY signal and the OPEN signal, the calculation control section 241 of a controller 340 instructs a drive section 144 to apply a voltage to the upper electrode 194 of the actuator 183 corresponding to the empty ink cartridge 20A, after a lapse of a specified time (e.g., one second). Upon the voltage being applied, the dielectric elastomer 193 is deformed like a bow, pressing upward the second arm portion 81*b* of the locking member 81, so that the locking state between the locking portion 81*c* and the locked portion 76 is released. Thereby, in the state where the ink outlet 60*a* of the first unit 50 is coupled to the ink inlet 90*a* of the cartridge mounting portion 119, the second unit 51 slides away from the first unit 50 under the force applied from the spring 52, and protrudes outward farther than the cover 8 in the closed position.

In accordance with the above described configuration, when the ink cartridge 20A is empty and the user opens the cover 8, the second unit 51 moves relative to the first unit 50. Therefore, it becomes possible to avoid that the user inadvertently pulls out the wrong ink cartridge which is not empty and to prevent entry of air bubbles or foreign matter, such as dust, or falling of liquid droplets. In addition, after the cover 8 is opened, the second unit 51 slides. This makes it possible to dispose the cartridge mounting portion 19 closer to the cover 8. As a result, the size of the ink jet printer can be reduced. Furthermore, since the dielectric elastomer 193 is used as the actuator, the size of the ink jet printer can be further reduced.

(Embodiment 5)

Figure 18:
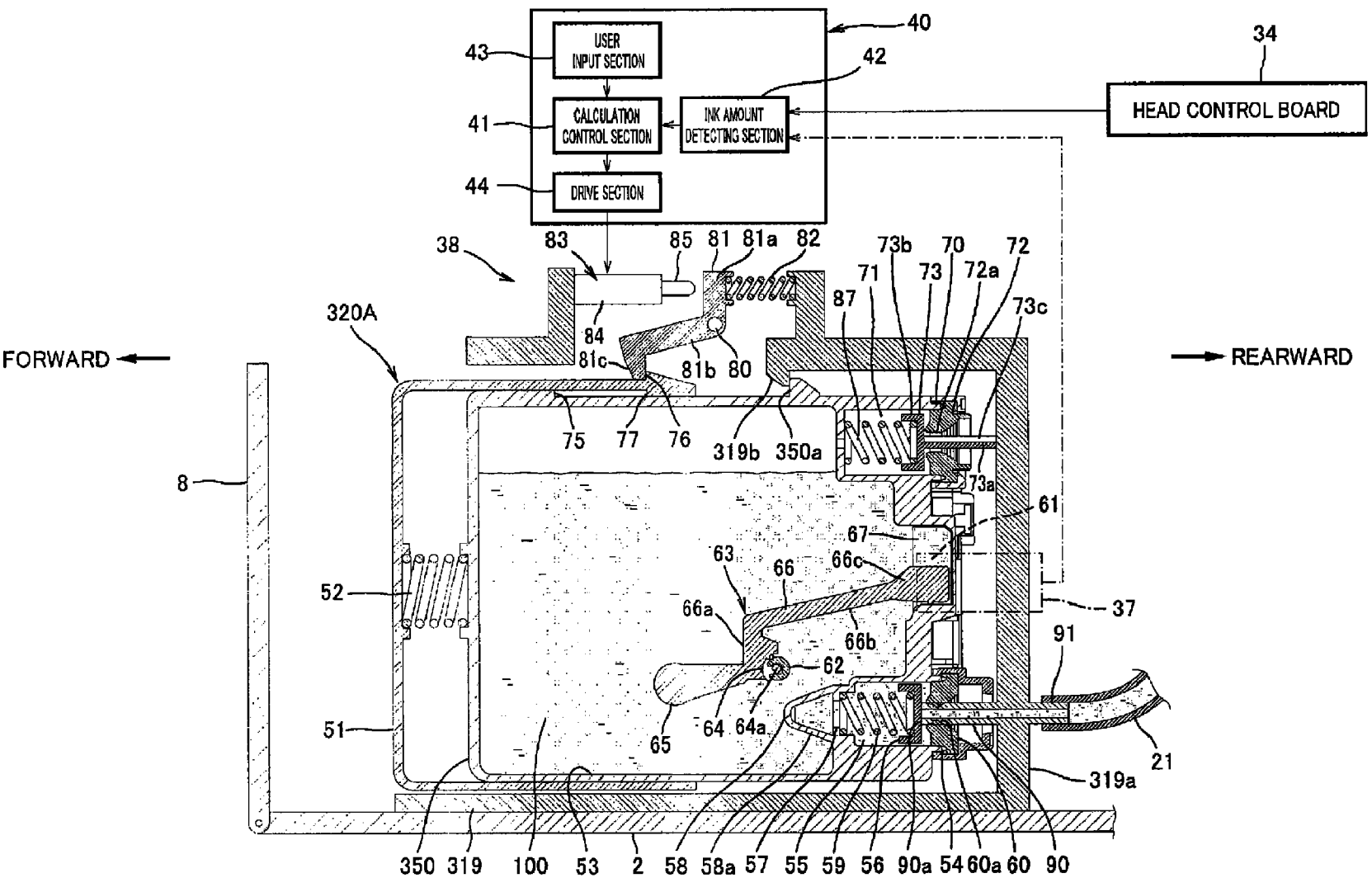
FIG. 18 is a vertical sectional view showing a region in the vicinity of an ink cartridge mounted to an ink jet printer according to a fifth embodiment of the present invention.

FIG. 18 is a vertical sectional view showing a region in the vicinity of an ink cartridge 320A mounted to an ink jet printer according to a fifth embodiment of the present invention. The fifth embodiment is different from the first embodiment in that a first unit 350 of the ink cartridge 320A is locked with respect to a cartridge mounting portion 319. In the fifth embodiment, the same reference numerals as those in the first embodiment denote the same or corresponding parts which will not be further described.

Referring to FIG. 18, the first unit 350 of the ink cartridge 320A has a locked portion 350*a* formed on an upper surface thereof so as to protrude upward, and a locking portion 319*b* protrudes downward from a location of the cartridge mounting portion 319 corresponding to the locked portion 350*a* of the first unit 350. In a state where the ink cartridge 320A is mounted to the cartridge mounting portion 319, the locking portion 319*b* is locked with respect to the locked portion 350*a*. The force for locking the locking portion 319*b* with respect to the locked portion 350*a* is set so that the locking portion 319*b* is unlocked with respect to the locked portion 350*a* when the user grabs the ink cartridge 320A and pulls it toward the cover 8.

In accordance with the above described configuration, when the second unit 51 is unlocked with respect to the locking member 81 and slides toward the cover 8 under the force applied from the spring 52, a coupling state between the ink outlet 60*a* and the ink inlet 90*a* can be surely maintained, because the locking portion 319*b* locks the locked portion 350*a*. Instead of the locking portion 319*b*, a locking lever which is configured to be unlocked with respect to the locked portion 350*a* by the user's hand operation may be provided. The locking structure of the present embodiment may be applied to the second to fourth embodiments.

(Embodiment 6)

Figure 19:
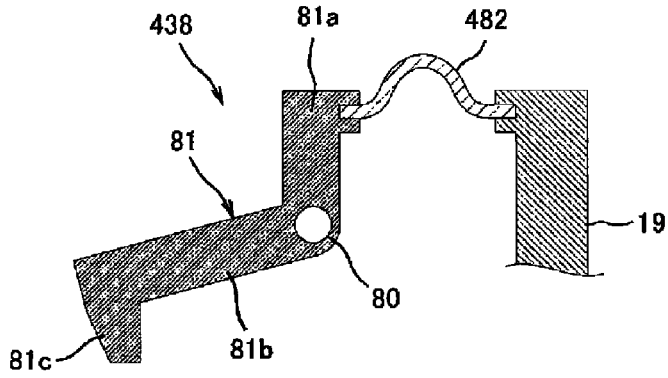
FIG. 19 is a vertical sectional view of a locking device in an ink jet printer according to a sixth embodiment of the present invention.

FIG. 19 is a vertical sectional view of a locking device 438 in an ink jet printer according to a sixth embodiment of the present invention. The sixth embodiment is different from the first embodiment in that a leaf spring 482 is used as a biasing member of the locking device 438. In the sixth embodiment, the same reference numerals as those in the first embodiment denote the same or corresponding parts, which will not be further described.

Referring to FIG. 19, the locking device 438 includes the leaf spring 482 interposed between the first arm portion 81*a* of the locking member 81 and a wall surface of the cartridge mounting portion 19. The leaf spring 482 is formed of a metal plate and is interposed between the first arm portion 81*a* and the wall surface of the cartridge mounting portion 19 in a state where the leaf spring 482 is curved to provide an elastic force so that the locking member 81 is in a locking state. Furthermore, the locking structure of the present embodiment may be applied to the second to fifth embodiments.

(Embodiment 7)

Figure 20:
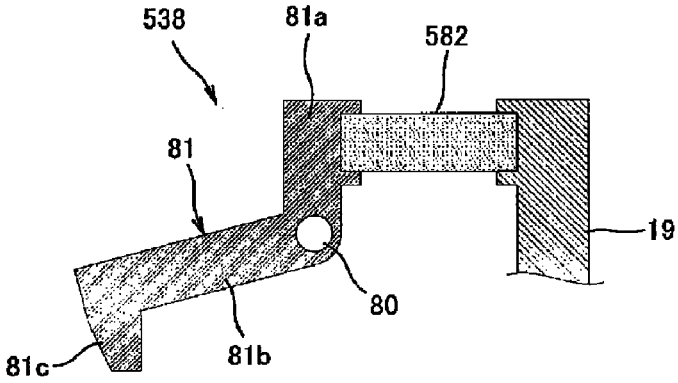
FIG. 20 is a vertical sectional view of a locking device in an ink jet printer according to a seventh embodiment of the present invention.

FIG. 20 is a vertical sectional view of a locking device 538 in an ink jet printer according to a seventh embodiment of the present invention. The seventh embodiment is different from the first embodiment in that an elastic rubber 582 is used as a biasing member of the locking device 538. In the fourth embodiment, the same reference numerals as those in the first embodiment denote the same or corresponding parts, which will not be further described.

Referring to FIG. 20, the locking device 538 includes the elastic rubber 582 interposed between the first arm portion 81*a* of the locking member 81 and a wall surface of the cartridge mounting portion 19. The elastic rubber 582 is configured to apply the elastic force to cause the locking member

81 to be in the locking state. A member interposed between the first arm portion 81*a* of the locking member 81 and the wall surface of the cartridge mounting portion 19 is not intended to be limited to rubber but may be other suitable elastic members. The locking structure of the present embodiment may be applied to the second to fifth embodiments.

(Embodiment 8)

Figure 21:
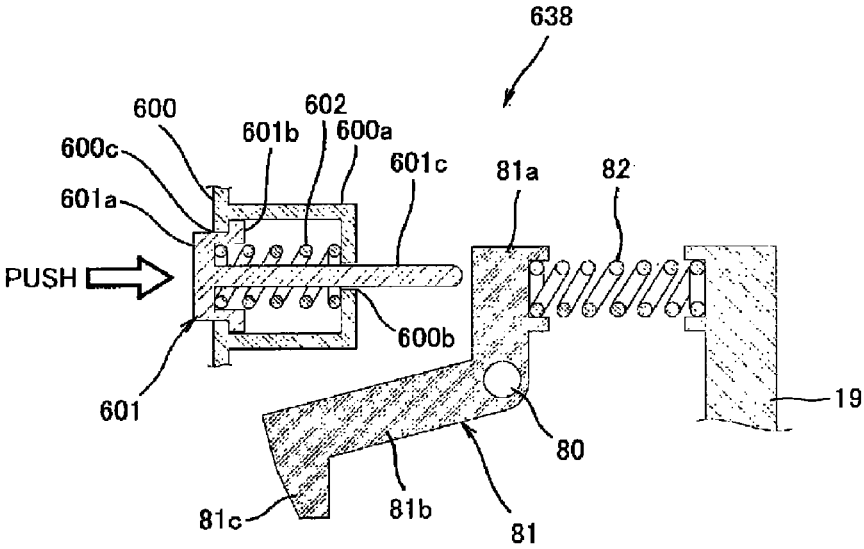
FIG. 21 is a vertical sectional view of a locking device in an ink jet printer according to an eighth embodiment of the present invention.

FIG. 21 is a vertical sectional view of a locking device 638 in an ink jet printer according to an eighth embodiment of the present invention. The eighth embodiment is different from the first embodiment in that unlocking of the locking device 638 is carried out by the user's hand operation. In the eighth embodiment, the same reference numerals as those in the first embodiment denote the same or corresponding parts, which will not be further described.

Referring to FIG. 21, the locking device 638 has a hand-operated switch 601 for causing the locking member 81 to turn to the unlocking state. The hand-operated switch 601 is attached to a casing 600 such that it is exposed outside the casing 600 of the printer. To be specific, the casing 600 has a switch accommodating portion 600*a*, and a through hole 600*b* is formed on a wall surface of the switch accommodating portion 600*a* which is opposite to the first arm portion 81*a* of the locking member 81. The hand-operated switch 601 includes a push portion 601*a* disposed in the opening of the switch accommodating portion 600*a* and a shaft portion 601*c* protruding from the push portion 601*a* through the through hole 600*b*.

A disengagement preventing ring portion 600*c* is formed around a periphery of the opening of the switch accommodating portion 600*a* so as to protrude inward. A disengagement preventing flange portion 601*b* is formed around an outer periphery of the push portion 601*a* so as to protrude outward and make contact with a surface of the ring portion 600*c* which is on an inner side of the accommodating portion 600*a*. A spring 602 is inserted into the shaft portion 601*c* to apply a force to the push portion 601*a* so that the shaft portion 601*c* is away from the first arm portion 81*a*. In this structure, when the user pushes the push portion 601*a* of the hand-operated switch 601 with a finger, the shaft portion 601*c* pushes the first arm portion 81*a* of the locking member 81, causing the locking member 81 to turn to the unlocking state. The locking structure of the present embodiment may be applied to the second to seventh embodiments.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A liquid droplet ejecting apparatus comprising:

a liquid cartridge including a liquid storing chamber and a liquid outlet, the liquid storing chamber being configured to store a liquid, the liquid outlet being configured to outflow the liquid stored in the liquid storing chamber;

a cartridge mounting portion configured to mount the liquid cartridge thereto removably, the cartridge mounting portion having a liquid inlet coupled to the liquid outlet of the liquid cartridge mounted to the cartridge mounting portion;

a liquid ejecting head configured to be supplied with the liquid inflowing from the liquid inlet and eject the supplied liquid; and a locking device configured to lock the liquid cartridge mounted to the cartridge mounting portion;

wherein the liquid cartridge includes:

a first unit having the liquid storing chamber and the liquid outlet;

a second unit configured to move relative to the first unit between a close position where the second unit is close to the first unit and a distant position where the second unit is distant from the first unit; and a biasing member configured to apply a force to cause the second unit in the close position to move toward the distant position;

wherein the locking device is configured to lock the second unit in the close position in a state where the liquid cartridge is mounted to the cartridge mounting portion;

wherein in response to that the second unit moves from the close position to the distant position under the force applied from the biasing member, in a state where the locking device is in an unlocking state, the liquid inlet and the liquid outlet are maintained to be coupled to each other, and wherein a force for coupling the liquid outlet and the liquid inlet to each other is set larger than a force applied to the first unit in response to which the second unit moves from the close position to the distant position under the force applied from the biasing member.

2. The liquid droplet ejecting apparatus according to claim 1, wherein in a state where the liquid inlet and the liquid outlet are coupled to each other, the second unit in the distant position is grabbed by a user more easily than the second unit in the close position.

3. The liquid droplet ejecting apparatus according to claim 1, wherein in a state where the liquid inlet and the liquid outlet are coupled to each other, the second unit in the distant position is more distant from the liquid inlet than the second unit in the close position.

4. The liquid droplet ejecting apparatus according to claim 1, wherein the cartridge mounting portion is configured to mount a plurality of liquid cartridges;

wherein in a state where the liquid inlet and the liquid outlet are coupled to each other, the second unit in the distant position is more distant from adjacent liquid cartridges than the second unit in the close position.

5. The liquid droplet ejecting apparatus according to claim 1, further comprising:

a cover configured to open and close an entrance for the cartridge mounting portion;

wherein in a state where the liquid inlet and the liquid outlet are coupled to each other, the second unit in the distant position is closer to the cover than the second unit in the close position.

6. The liquid droplet ejecting apparatus according to claim 1, further comprising:

an actuator configured to perform an unlocking operation of the locking device; and a controller configured to control the actuator to perform the unlocking operation.

7. The liquid droplet ejecting apparatus according to claim 6, further comprising:

a liquid amount detector configured to detect a liquid empty state in which an amount of the liquid stored in the liquid cartridge is a predetermined amount or less;

wherein the controller controls the actuator to perform the unlocking operation of the locking device, based on the liquid empty state detected by the liquid amount detector.

8. The liquid droplet ejecting apparatus according to claim 6, further comprising:

a cover configured to open and close an entrance for the cartridge mounting portion;

a cover opening operation detector configured to detect that the cover is open; and a liquid amount detector configured to detect a liquid empty state in which an amount of the liquid stored in the liquid cartridge is a predetermined amount or less;

wherein the controller controls the actuator to perform the unlocking operation of the locking device, in response to that the liquid amount detector detects the liquid empty state and the cover opening operation detector detects that the cover is open.

9. The liquid droplet ejecting apparatus according to claim 6, further comprising:

an ejection command generator configured to generate an ejection command in response to a user's operation;

wherein the controller controls the actuator to perform the unlocking operation of the locking device based on the ejection command.

10. The liquid droplet ejecting apparatus according to claim 6, wherein the cartridge mounting portion is configured to mount a plurality of liquid cartridges;

wherein the locking device is a part of a plurality of locking devices respectively corresponding to the plurality of liquid cartridges; and wherein the controller controls the actuator to perform the unlocking operation of a specified locking device which is selected from the plurality of locking devices.

11. The liquid droplet ejecting apparatus according to claim 6, wherein the actuator includes a solenoid.

* * * * *